US007162187B2

(12) United States Patent
Koichi et al.

(10) Patent No.: US 7,162,187 B2
(45) Date of Patent: Jan. 9, 2007

(54) IMAGE FORMING APPARATUS AND IMAGE FORMING METHOD

(75) Inventors: Yasushi Koichi, Kanagawa (JP); Mitsuo Aoki, Shizuoka (JP); Bing Shu, Shizuoka (JP); Setsuo Soga, Tokyo (JP); Koji Suzuki, Kanagawa (JP); Yutaka Takahashi, Tokyo (JP); Tadashi Kasai, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 113 days.

(21) Appl. No.: 10/879,320

(22) Filed: Jun. 30, 2004

(65) Prior Publication Data

US 2005/0025535 A1 Feb. 3, 2005

(30) Foreign Application Priority Data

Jun. 30, 2003 (JP) ..... 2003-188303
Sep. 11, 2003 (JP) ..... 2003-320204
Sep. 19, 2003 (JP) ..... 2003-328334

(51) Int. Cl.
*G03G 15/08* (2006.01)
*G03G 15/16* (2006.01)

(52) U.S. Cl. ..... 399/252; 399/297; 399/313; 430/120; 430/126; 430/110.1

(58) Field of Classification Search ..... 399/222, 399/252, 279, 284, 297, 313, 318; 430/120, 430/126, 110.1, 110.3, 110.4
See application file for complete search history.

(56) References Cited

U.S. PATENT DOCUMENTS 3,992,089 A 11/1976 Hirose et al. ..... 399/144
4,171,899 A 10/1979 Yanagawa et al. ..... 399/317
4,172,976 A 10/1979 Namiki et al. ..... 219/469
4,193,679 A 3/1980 Mochizuki et al. ..... 355/1
4,201,465 A 5/1980 Oyama et al. ..... 399/149
4,284,875 A 8/1981 Namiki et al. ..... 219/216
4,331,100 A 5/1982 Mochizuki et al. ..... 399/277
4,383,497 A * 5/1983 Tajima ..... 399/282
4,406,536 A 9/1983 Suzuki et al. ..... 399/259
4,502,780 A 3/1985 Suzuki et al. ..... 399/349
4,515,467 A 5/1985 Suzuki ..... 399/354
4,522,481 A 6/1985 Imai et al. ..... 399/43
4,551,005 A 11/1985 Koichi ..... 399/72
4,562,136 A 12/1985 Inoue et al. ..... 430/108.23
4,584,254 A 4/1986 Nakayama et al. ..... 430/111.1
4,590,141 A 5/1986 Aoki et al. ..... 430/108.23
4,639,117 A 1/1987 Murai et al. ..... 399/60
4,672,016 A 6/1987 Isoda et al. ..... 430/111.1
4,734,737 A 3/1988 Koichi ..... 399/58
4,737,821 A 4/1988 Suzuki et al. ..... 399/130
4,813,868 A 3/1989 Soga ..... 432/8

(Continued)

FOREIGN PATENT DOCUMENTS

JP 7-5776 1/1995

(Continued)

OTHER PUBLICATIONS

U.S. Appl. No. 07/714,669, filed Jun. 13, 1991, Hirano et al.

(Continued)

*Primary Examiner*—Sophia S. Chen
(74) *Attorney, Agent, or Firm*—Oblon, Spivak, McClelland, Maier & Neustadt, P.C.

(57) ABSTRACT

In an image forming apparatus, a toner image is formed on a photosensitive element and a transfer roller, which carries a transfer medium, is pressed against a photosensitive element at a pressure of from 20.4 N/cm$^2$ to 200 N/cm$^2$.

12 Claims, 11 Drawing Sheets

U.S. PATENT DOCUMENTS 4,885,466 A 12/1989 Koichi et al. ..... 399/34
4,885,612 A 12/1989 Satoh et al. ..... 399/356
4,908,290 A 3/1990 Watanabe et al. ..... 430/109.2
4,927,728 A 5/1990 Isoda et al. ..... 430/111.1
4,933,250 A 6/1990 Nakayama et al. ..... 430/108.5
4,934,930 A 6/1990 Soga ..... 432/60
4,951,160 A 8/1990 Nagahara et al. ..... 358/1.7
4,956,258 A 9/1990 Watanabe et al. ..... 430/109.3
4,962,394 A 10/1990 Sohmiya et al. ..... 399/60
4,977,308 A 12/1990 Soga ..... 219/469
4,980,258 A 12/1990 Aoki et al. ..... 430/108.2
4,987,457 A 1/1991 Mochizuki et al. ..... 399/331
4,989,043 A 1/1991 Suzuki et al. ..... 399/39
5,006,896 A 4/1991 Koichi et al. ..... 399/74
5,038,175 A 8/1991 Sohmiya et al. ..... 399/58
5,049,939 A 9/1991 Koichi ..... 399/48
5,061,588 A 10/1991 Fushimi et al. ..... 430/109.2
5,083,160 A 1/1992 Suzuki et al. ..... 399/39
5,128,110 A 7/1992 Soga et al. ..... 422/168
5,172,169 A 12/1992 Takashima et al. ..... 399/281
5,200,780 A 4/1993 Koichi ..... 399/73
5,220,383 A 6/1993 Enoki et al. ..... 399/285
5,225,302 A 7/1993 Isoda et al. ..... 430/111.32
5,239,344 A 8/1993 Enoki et al. ..... 399/285
5,245,391 A 9/1993 Suzuki et al. ..... 399/285
5,286,918 A 2/1994 Iwata et al. ..... 399/119
5,311,263 A 5/1994 Suzuki et al. ..... 399/276
5,315,061 A 5/1994 Suzuki et al. ..... 399/239
5,327,196 A 7/1994 Kato et al. ..... 399/58
5,339,141 A 8/1994 Suzuki et al. ..... 399/285
5,380,616 A 1/1995 Aoki et al. ..... 430/110.1
5,387,965 A 2/1995 Hasegawa et al. ..... 399/60
5,394,231 A 2/1995 Sudo et al. ..... 399/228
5,400,127 A 3/1995 Arai et al. ..... 399/71
5,424,814 A 6/1995 Suzuki et al. ..... 399/284
5,450,172 A 9/1995 Suzuki et al. ..... 399/223
5,451,713 A 9/1995 Suzuki et al. ..... 399/285
5,467,175 A 11/1995 Takagaki et al. ..... 399/281
5,474,869 A 12/1995 Tomita et al. ..... 430/102
5,482,807 A 1/1996 Aoki et al. ..... 430/108.22
5,508,787 A 4/1996 Hasegawa et al. ..... 399/31
5,519,316 A 5/1996 Hagiwara et al. ..... 324/204
5,519,472 A * 5/1996 Ojima et al. ..... 399/274
5,614,347 A 3/1997 Aoki et al. ..... 430/108.1
5,674,408 A 10/1997 Suzuki et al. ..... 216/39
5,678,153 A 10/1997 Okamoto et al. ..... 399/327
5,679,462 A 10/1997 Soga et al. ..... 428/447
5,741,616 A 4/1998 Hirano et al. ..... 430/101
5,774,768 A * 6/1998 Hazama et al. ..... 399/170
5,774,771 A * 6/1998 Kukimoto et al. ..... 430/126
5,812,917 A 9/1998 Iwata et al. ..... 399/281
5,873,017 A 2/1999 Soga et al. ..... 399/302
5,912,100 A 6/1999 Aoki et al. ..... 430/108.7
5,994,016 A 11/1999 Kuramoto et al. ..... 430/108.3
6,004,715 A 12/1999 Suzuki et al. ..... 430/111.3
6,060,201 A 5/2000 Kinoshita et al. ..... 430/45
6,067,435 A 5/2000 Soga et al. ..... 399/302
6,112,046 A 8/2000 Suzuki et al. ..... 399/359
6,120,960 A 9/2000 Aoki et al. ..... 430/109.2
6,168,894 B1 1/2001 Aoki et al. ..... 430/99
6,248,488 B1 6/2001 Kinoshita et al. ..... 430/45
6,360,069 B1 * 3/2002 Mimura et al. ..... 399/286
6,403,275 B1 6/2002 Kuramoto et al. ..... 430/111.4
6,496,666 B1 12/2002 Hayashi et al. ..... 399/69
6,593,048 B1 7/2003 Sasaki et al. ..... 430/106.1
6,667,141 B1 12/2003 Iwamoto et al. ..... 430/111.4
6,699,632 B1 3/2004 Higuchi et al. ..... 430/110.3
6,790,575 B1 9/2004 Sasaki et al. ..... 430/106.1
6,956,594 B1 * 10/2005 Iida et al. ..... 347/131
2003/0095814 A1 * 5/2003 Miyakawa et al. ..... 399/252
2003/0152856 A1 * 8/2003 Mizoe et al. ..... 430/126 X
2004/0018028 A1 * 1/2004 Chiba et al. ..... 399/149
2004/0191665 A1 * 9/2004 Watanabe et al. ..... 399/279 X
2005/0002701 A1 * 1/2005 Ikeguchi et al. ..... 399/267

FOREIGN PATENT DOCUMENTS

JP 9-62028 3/1997
JP 2000-221800 8/2000
JP 2002-221800 8/2000
JP 2001-209255 8/2001

OTHER PUBLICATIONS

U.S. Appl. No. 07/485,443, filed Feb. 27, 1990, Aoki et al.
U.S. Appl. No. 07/269,128, filed Nov. 9, 1988, Asahina et al.
U.S. Appl. No. 06/735,420, filed May 17, 1985, Isoda et al.
U.S. Appl. No. 06/656,115, filed Sep. 28, 1984, Isoda et al.
U.S. Appl. No. 06/479,406, filed Mar. 28, 1983, Aoki et al.
U.S. Appl. No. 06/471,387, filed Mar. 2, 1983, Inoue et al.
U.S. Appl. No. 07/289,253, filed Dec. 23, 1988, Suzuki et al.
U.S. Appl. No. 07/597,881, filed Oct. 12, 1990, Suzuki et al.
U.S. Appl. No. 07/983,297, filed Nov. 30, 1992, Suzuki et al.
U.S. Appl. No. 08/298,297, filed Sep. 1, 1994, Suzuki et al.
U.S. Appl. No. 07/674,161, filed Mar. 25, 1991, Suzuki et al.
U.S. Appl. No. 08/775,604, filed Dec. 31,1996, Aoki et al.
U.S. Appl. No. 09/010,583, filed Jan. 22, 1998, Aoki et al.
U.S. Appl. No. 09/905,872, filed Jul. 17, 2001, Sasaki et al.
U.S. Appl. No. 09/965,826, filed Oct. 1, 2001, Higuchi et al.
U.S. Appl. No. 10/077,813, filed Feb. 20, 2002, Matsuda et al.
U.S. Appl. No. 10/151,103, filed May 21, 2002, Kondo et al.
U.S. Appl. No. 10/158,069, filed May 31, 2002, Matsuda et al.
U.S. Appl. No. 10/252,070, filed Sep. 23, 2002, Aoki et al.
U.S. Appl. No. 10/329,538, filed Dec. 27, 2002, Higuchi et al.
U.S. Appl. No. 10/355,039, filed Jan. 31, 2003, Suzuki et al.
U.S. Appl. No. 10/424,077, filed Apr. 28, 2003, Suzuki et al.
U.S. Appl. No. 10/631,727, filed Aug. 1, 2003, Suzuki et al.
U.S. Appl. No. 10/645,614, filed Aug. 22, 2003, Sohmiya et al.
U.S. Appl. No. 10/879,320, filed Jun. 30, 2004, Koichi et al.
U.S. Appl. No. 11/197,548, filed Aug. 5, 2005, Kasai et al.
U.S. Appl. No. 11/408,031, filed Apr. 21, 2006, Shu et al.

* cited by examiner

RANK 5
EVALUATION: OK

RANK 3
EVALUATION: △

RANK 1
EVALUATION: NG

FIG.11A RANK 5 EVALUATION: OK *10 POINTS ROAR ENVIRONMENT*

FIG.11B RANK 3 EVALUATION: Δ *10 POINTS ROAR ENVIRONMENT*

FIG.11C RANK 1 EVALUATION: NG *10 POINTS ROAR ENVIRONMENT*

TONER PARTICLE SIZE 4.2 μm

TONER PARTICLE SIZE 6.8 μm

TONER PARTICLE SIZE 9.0 μm

DEGRADATION LEVEL OF GARANULARITY 0.15

DEGRADATION LEVEL OF GARANULARITY 0.10

DEGRADATION LEVEL OF GARANULARITY 0.04

TONER PARTICLE SIZE 4.2 μm

TONER PARTICLE SIZE 6.8 μm

TONER PARTICLE SIZE 9.0 μm

DEGRADATION LEVEL
OF GARANULARITY
0.15

DEGRADATION LEVEL
OF GARANULARITY
0.10

DEGRADATION LEVEL
OF GARANULARITY
0.04

IMAGE FORMING APPARATUS AND IMAGE FORMING METHOD

CROSS-REFERENCE TO RELATED APPLICATIONS

The present document incorporates by reference the entire contents of Japanese priority document, 2003-188303 filed in Japan on Jun. 30, 2003, Japanese priority document, 2003-320204 filed in Japan on Sep. 11, 2003, and Japanese priority document, 2003-328334 filed in Japan on Sep. 19, 2003.

BACKGROUND OF THE INVENTION

1) Field of the Invention

The present invention relates to an image forming apparatus such as a copying machine, a facsimile, or a printer. More specifically, the present invention relates to an image forming apparatus that electrostatically transfers a toner image from an image carrier to a paper or the like.

2) Description of the Related Art

Image forming apparatus such as copying machines, facsimiles, or printers are widely known. Mainly two types of transfer devices are used in the image forming apparatuses. In the first type, a toner image is electrostatically transferred from an image carrier to a roller member and then the image from the roller member is transferred to a recording element. Generally the image carrier is a photosensitive element, the roller member is a transfer roller, and the recording element is a transfer paper. In the second type, the toner image is directly electrostatically transferred from the image carrier to transfer paper. In the second type, the recording element is held between the photosensitive element and the roller member when transferring the toner image to it.

In recent years, there is an increasing demand for better image quality. The image quality can be increased by improving dot reproducibility. To improve the dot reproducibility, it is necessary to use a toner (sometimes "toner" is used to mean toner particles) that is finer, more spherical, more uniform, and that can be charged more uniformly, than the conventional toner. Polymer toner is an example of such a toner. Because the polymer toner is almost spherical, it has low aggregation. In other words, because non-electrostatic adhesion force between toner particles of the polymer toner is small, the toner particles can easily and smoothly move on the transfer paper. Therefore, uniform developing can be achieved, and smooth halftone images can be obtained with the polymer toner. However, because the polymer toner has low aggregation, there is a problem that the polymer toner easily gets transformed into transfer dust.

When a toner image is electrostatically transferred from a transfer source to a transfer target, some toner particles fly off and result into the transfer dust.

One of causes of the transfer dust to occur includes an abrupt change in an electric field or a peel discharge phenomenon that occurs near the entrance/exit of a transfer nip formed at a contact point between the transfer element and the photosensitive element.

Japanese Patent Application Laid Open (JP-A) No. 2000-221800 discloses a technology of preventing transfer dust by providing a pushing roller that pushes an intermediate transfer belt from its inner peripheral side against a photosensitive drum at a contact nip between the photosensitive drum and the intermediate transfer belt to increase toner aggregation.

JP-A No. 2001-209255 discloses a technology of suppressing transfer dust by defining a volume resistivity of the transfer target as $10^8$ Ω·cm to $10^{14}$ Ω·cm, a linear velocity ratio between the transfer source and the transfer target as 0.85 to 1.10, a nip pressure as 5 g/cm$^2$ or higher, toner aggregation as 3% to 15%, and an apparent density as 0.35 g/cm$^3$ to 0.50 g/cm$^3$.

JP-A No. H9-062028 discloses a technology of suppressing transfer dust by setting an amount of coat with toner on a developer carrying element to 0.5 mg/cm$^2$ to 1.5 mg/cm$^2$.

When a difference in rotational speed occurs between the photosensitive element and the transfer roller, shearing force occurs between the photosensitive element and the transfer paper. If the aggregation of toner particles is low, a toner layer cannot accommodate the shearing force, which easily causes occurrence of a phenomenon such that the toner layer collapses. The phenomenon is so-called "transfer blur" such that the collapse causes a transferred image to blur. Particularly, when a ratio of an image area in the toner layer is higher, the transfer blur occurs more easily. To solve this problem, the photosensitive element and the transfer roller are desired to rotate at a speed perfectly equal to each other. JP-A No. H9-062028 describes a technology of causing the transfer roller to rotate, from a drive source of the photosensitive element through a gear, at a speed equal to that of the photosensitive element.

JP-A No. 2001-115425 describes a technology of defining a position and a contact pressure of a transfer roller. JP 2000-221800 A discloses a technology of pushing a floating roller against a photosensitive element. JP-A No. 2001-209255 discloses a technology of defining volume resistivity of an intermediate transfer element and physical property of toner.

JP-A No. H7-005776 discloses a technology of applying transfer bias to a pushing roller using an amorphous-silicon photosensitive element and using capsule toner as toner. Furthermore, JP-A No. H9-062028 discloses, in order to achieve both prevention of voids in characters and improvement of printing accuracy, a technology of improving printing accuracy by rotating the transfer roller at a speed equal to that of the photosensitive element, and a technology of preventing voids in characters as a side effect by using toner characteristics.

However, if the transfer roller is driven from a drive source of the photosensitive element via gears and a belt, the transfer roller cannot be made to rotate at a speed perfectly equal to that of the photosensitive element. This is caused by changes in torque due to engagement of gear teeth, and slack or deflection of the belt, which may cause the transfer blur to occur.

The quality of images in the conventional electrophotographic system is greatly inferior to that of printed images such that granularity as an important index of high image quality is 0.3 or higher. The granularity is expressed by an average value of 40 to 80 in average luminance, explained later. In order to obtain high image quality having a granularity of 0.25 or lower, it is required to improve degradation in images called as transfer dust, blur as an blurred image, or an uneven toner image that is obtained as a result of transferring insufficient toner to a transfer element (hereinafter, "uneven toner" or "uneven toner image"), occurring in a transfer process. However, the conventional technology has difficulty in achieving a granularity of 0.25 or lower.

SUMMARY OF THE INVENTION

It is an object of the present invention to solve at least the problems in the conventional technology.

An image forming apparatus according to an aspect of the present invention includes an image carrier that is rotatable and that carries a toner image; a transfer unit to which the toner image on the image carrier is electrostatically transferred; and a transferring unit that is rotatably pushed against the image carrier at a pressure of from 20.4 $N/cm^2$ to 200 $N/cm^2$. In this structure, the transfer unit is caused to pass in between the image carrier and the transferring unit.

An image forming apparatus according to another aspect of the present invention includes an image carrier that is rotatable and that carries a toner image; a developing unit that forms the toner image with toner in powder form on the image carrier in such a manner that thickness of a layer of toner of the toner image is equal to or less than three times of an average particle size of the toner; and a transferring unit that transfers the toner image to a transfer unit in such a manner that a ratio between dot areas of the toner image on the image carrier and on the transfer unit is from 0.8 to 1.1.

An image forming method according to still another aspect of the present invention includes forming a toner image with toner in powder form on an image carrier, which is rotatable, in such a manner that thickness of a layer of toner of the toner image is equal to or less than three times of an average particle size of the toner; and a transferring unit transferring the toner image to a transfer unit in such a manner that a ratio between dot areas of the toner image on the image carrier and on the transfer unit is from 0.8 to 1.1.

An image forming apparatus according to still another aspect of the present invention includes an image carrier that is rotatable and that carries a toner image; a developing unit that forms the toner image with toner in powder form on the image carrier in such a manner that thickness of a layer of toner of the toner image is between two to five times of an average particle size of the toner; and a transferring unit that transfers the toner image to a transfer unit in such a manner that a ratio between dot areas of the toner image on the image carrier and on the transfer unit is from 0.8 to 1.1.

An image forming method according to still another aspect of the present invention includes forming on an image carrier, which is rotatable, a toner image with toner in powder form on the image carrier in such a manner that thickness of a layer of toner of the toner image is between two to five times of an average particle size of the toner; and a transferring unit transferring the toner image to a transfer unit in such a manner that a ratio between dot areas of the toner image on the image carrier and on the transfer unit is from 0.8 to 1.1.

The other objects, features, and advantages of the present invention are specifically set forth in or will become apparent from the following detailed description of the invention when read in conjunction with the accompanying drawings.

BRIEF DESCRIPTION OF THE DRAWINGS

FIG. 11A to FIG. 11C are images of rank samples of voids due to insufficient transfer;

DETAILED DESCRIPTION

Exemplary embodiments of an image forming apparatus and an image forming method according to the present invention are explained in detail below with reference to the accompanying drawings.

Figure 1:
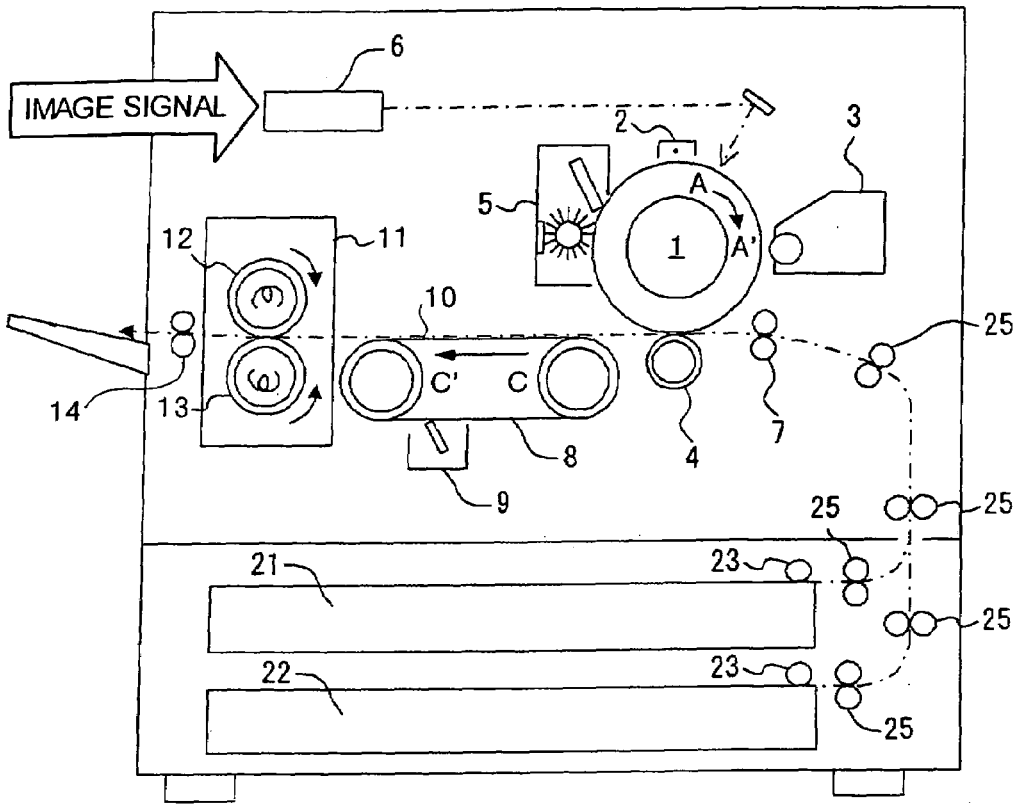
FIG. 1 is a schematic side view of an image forming apparatus according to a first embodiment of the present invention.

FIG. 1 is a schematic side view of an image forming apparatus according to a first embodiment of the present invention. As a drum-shaped photosensitive element (hereinafter, "photosensitive element") 1 that is a latent image carrier that carries a latent image, an existing photosensitive element such as an organic photoconductive element, an amorphous photosensitive element, or the like can be used, and in the first embodiment, amorphous silicon is used for the photosensitive element. An electrifying charger 2 uniformly charges the surface of the photosensitive element 1 while the photosensitive element 1 is made to rotate from an arrow A to an arrow A' in the figure. A laser optical device 6 subjects the surface thereof to a scanning and exposing process based on image information to form an electrostatic latent image thereon. The image information is sent from a personal computer (not shown). A developing device 3 develops the electrostatic latent image to form a toner image, and the toner image is electrostatically transferred to a transfer paper at a transfer nip, which is explained later. The developing device 3 contains a so-called two-component developer containing toner and magnetic carrier (not shown), and conveys the two-component developer to a position that faces the photosensitive element 1 to develop the electrostatic latent image thereby.

A plurality of paper feed cassettes 21 and 22, each of which contains a plurality of sheets of transfer paper as recording elements, are arranged mutually in a vertical direction in the lower side of a transfer roller 4. In the paper feed cassettes 21 and 22, paper feed rollers 23 that are pressed against topmost transfer paper are made to rotate at a predetermined timing to feed the transfer paper to a paper-feed conveying path. In the paper-feed conveying path, the transfer paper sent-out passes through a plurality of conveying roller pairs 25, and is held by a registration roller pair 7 to cause it to stop. The registration roller pair 7 sends out the transfer paper held thereby toward the transfer nip at a timing at which the toner image formed on the photosensitive element 1 is superimposed on the transfer paper. This timing allows the toner image and the transfer paper to be synchronized to and in tight contact with each other at the transfer nip. Then, the toner image is electrostatically transferred to the transfer paper caused by a transfer electric field and a nip pressure (transfer pressure).

Arranged on the right side of the transfer roller 4 in FIG. 1 is a paper conveying unit 8 in which a paper conveying belt 10 stretched by two rollers are made to endlessly move in a direction from an arrow C to an arrow C' in this figure. A fixing device 11 and a paper discharge roller pair 14 are serially arranged on further rightward positions of the paper conveying unit 8. The transfer paper with the toner image electrostatically transferred thereon is sent from the transfer nip onto the paper conveying belt 10 of the paper conveying unit 8 following rotation of the photosensitive element 1 and the transfer roller 4 to enter the fixing device 11. The fixing device 11 includes a heat source such as a halogen lamp and has a fixing nip formed with a fixing roller 12 and a pushing roller 13 that rotate at an equal speed to each other while being in contact with each other. The transfer paper having entered the fixing device 11 is held at the fixing nip to be subjected to heating and pressing processes, and the toner image is thereby fixed onto the surface of the transfer paper. The transfer paper is ejected from the fixing device 11 to the outside of the machine through the paper discharge roller pair 14. This fixing device 11 maintains the surface temperature of the fixing roller 12 and the pushing roller 13 at from 165° C. to 185° C. while forming the fixing nip with a width (length in a paper conveying direction) of 10 millimeters and a pressure of 9.3 N/cm$^2$ to perform the fixing process.

There is some toner that is not electrostatically transferred onto the transfer paper P at the transfer nip after a toner image is transferred and that remains on the surface of the photosensitive element 1 (hereinafter, "residual toner"). A photosensitive-element cleaner 5 removes the residual toner from the photosensitive element 1. A decharger (not shown) decharges the surface of the photosensitive element 1 cleaned in such a manner as explained above, and the electrifying charger 2 uniformly charges the surface thereof. A belt cleaning device 9 of the paper conveying unit 8 removes toner, having transferred from the photosensitive element 1 onto the paper conveying belt 10 at the transfer nip, from the paper conveying belt 10. The photosensitive-element cleaner 5 includes a stearic acid zinc applying unit that applies powder of stearic acid zinc onto the surface of the photosensitive element 1. The stearic acid zinc is obtained by scraping a stearic acid zinc rod. Application of the powder of stearic acid zinc onto the surface thereof after the cleaning allows reduction of a surface frictional coefficient of the photosensitive element 1 and improvement of transfer performance.

Figure 2:
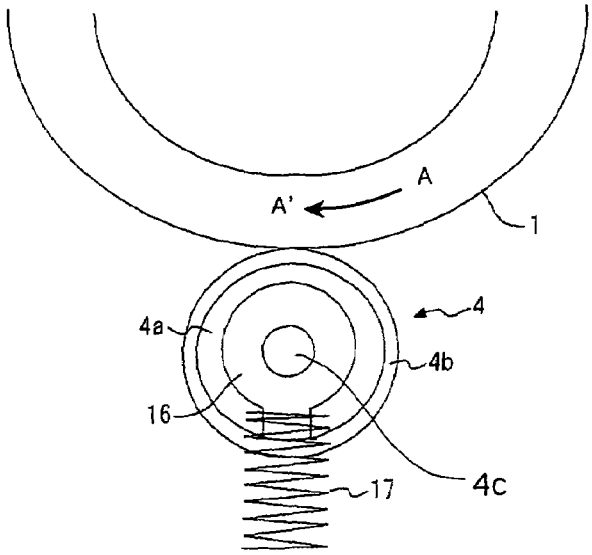
FIG. 2 is an enlarged schematic diagram of a transfer unit of the image forming apparatus.

FIG. 2 is a schematic diagram of a transfer unit of the image forming apparatus. The transfer roller 4 pushed against the photosensitive element 1 includes a core metal roller (not shown) made of a rigid material such as stainless steel or iron and having a diameter of 20 to 30 millimeters. The transfer roller 4 also includes a solid-state first elastic layer 4*a* formed of ethylene-propylene diene monomer (EPDM), silicon, nitrile-butadiene rubber (NBR), and urethane, and coated over the core metal roller. The transfer roller 4 further includes a second elastic layer 4*b* coated over the first elastic layer 4*a*. The second elastic layer 4*b* has characteristics controlled to as follows: thickness: 1.0 millimeter or more, hardness (Asker C, upon application of 1 Kg load): 30 to 60 degrees, and volume resistivity: $1\times10^9$ to $1\times10^{11}$ Ω·cm. The transfer roller 4 further includes shafts 4c that are projected from both ends of the core metal roller. The shafts 4*c* at both ends are rotatably supported by bearings 16, respectively, and the bearings 16 are biased by springs 17 toward the photosensitive element 1. The transfer roller 4 is pushed, by the bias, against the photosensitive element 1 at a high pressure of 20.4 N/cm$^2$ to 200 N/cm$^2$. This allows the transfer roller 4 to rotate following rotation of the photosensitive element 1 without provision of a drive unit in the transfer roller 4. Consequently, the transfer roller 4 and the photosensitive element 1 are made to rotate at the same speed, which does not cause the shearing force to act on the toner layer between the photosensitive element 1 and the transfer paper, and allows occurrence of transfer blur to be suppressed.

In the conventional image forming apparatus, one of causes by which the transfer dust occurs includes an abrupt change in an electric field or a peel discharge phenomenon that occurs near the entrance/exit of a transfer nip formed at a contact point between the transfer element and the photosensitive element. The causes are explained in detail below.

Figure 18:
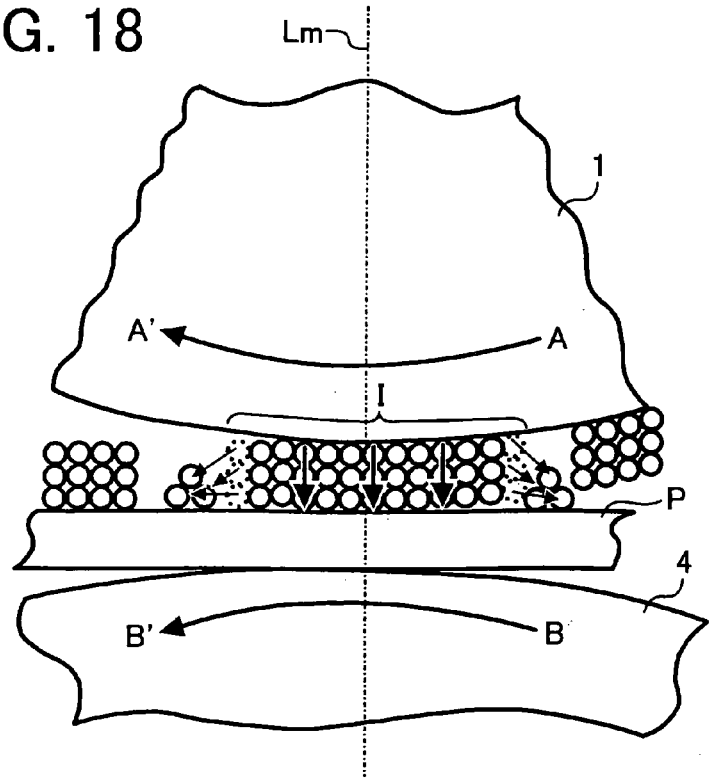
FIG. 18 is an enlarged schematic diagram of a transfer nip for transferring a toner image from the photosensitive element (image carrier) to a transfer element in the conventional image forming apparatus.

FIG. 18 is an enlarged schematic diagram of a transfer nip for transferring a toner image from the photosensitive element 1 (image carrier) to a transfer element in the conventional image forming apparatus. The photosensitive element 1 that carries a toner image I formed with a plurality of toner particles is made to rotate by a drive unit (not shown) from a sign A to an sign A' in the figure. The transfer roller 4 is in contact with the photosensitive element 1 at the transfer nip. A power source (not shown) applies transfer bias to the transfer roller 4, by which a transfer electric field is formed between the surface of the photosensitive element 1 and the surface of the transfer roller 4.

At the transfer nip, the surface of the photosensitive element 1 and the surface of a transfer paper P are closest at a median line Lm of the transfer nip and near around it, and the toner particles are present with almost no spaces between the two. Such toner particles are pushed too strongly to move toward spaces around them, which causes the toner particles to be kept restricted to the portion around the median line Lm of the transfer nip.

At the entrance/exit of the transfer nip, on the other hand, both of the surfaces are apart from each other because of the curvature of the surface of the photosensitive element 1. Therefore, a fine air gap where there are no toner particles is formed at the entrance/exit of the transfer nip (hereinafter, "nip-entrance gap or nip-exit gap"), and pressure to each toner particle is weak thereat. Discharge occurs at the nip-entrance gap or the nip-exit gap to cause impact to be imparted to the toner particles.

On the other hand, electrostatic force F that acts on the toner particles between the transfer roller 4 and the photosensitive element 1 is expressed by the following equation.

$$F=qE \tag{1}$$

Where q is charged amount of toner, and E is electric field intensity around toner particles. The electric field intensity E is expressed by the following equation.

$$E = \frac{Vf - Vt}{\frac{df}{\varepsilon f} + \frac{dT}{\varepsilon T} + \frac{dt}{\varepsilon t} + \frac{dg}{\varepsilon g}} \tag{2}$$

Where Vf: potential on the surface of transfer source

Vt: potential on the surface or transfer target df/∈f: dielectric thickness of transfer source dT/∈T: dielectric thickness of toner layer carried on transfer source dt/∈t: dielectric thickness of transfer target dg/∈g: dielectric thickness of air gap in transfer direction It is understood from the equation (2) that the electric field intensity E around toner particles changes between the transfer roller 4 and the photosensitive element 1 according to a size of the air gap in the direction of a thickness of the nip. When a front portion of the toner image I is preceding to the entrance of the transfer nip, the toner particles at the front portion undergo impact due to the discharge at the nip-entrance gap, but they are followed by other toner particles at the rear side thereof. Furthermore, there is a narrower space at the front. Therefore, the toner particles at the front portion are kept restricted to that position even if they undergo the impact due to the discharge.

In contrast to this, the toner particles at the rear portion of the toner image I are not followed by other toner particles that are supposed to be at the further rear portion. Therefore, there is a wide space in the rear side, which allows the toner particles at the rear portion to move slightly rearward by the impact upon the discharge. This causes the electric field intensity E, which acts on the toner particles, to change from a value based on the nip-entrance gap to a value based on a larger air gap. Therefore, the electrostatic force F that acts on the toner particles abruptly changes. Such an abrupt change of the electrostatic force F and inertial force due to the impact upon the discharge are combined to cause the toner particles at the rear portion of the toner image I to easily fly off further rearward at the entrance of the transfer nip as shown in FIG. 18.

On the other hand, at the exit of the transfer nip, the toner particles at the front portion of the toner image I easily fly off frontward in the same action as that of the fly-off at the entrance of the transfer nip. Furthermore, in addition to the discharge at the nip-exit gap, so-called peel discharge occurs between the transfer roller 4 and the photosensitive element 1 when the toner image is separated from the transfer source (transfer element or image carrier). This peel discharge causes fly-off of the toner particles at the front portion to be prompted.

The image forming apparatus according to the first embodiment of the present invention suppresses transfer dust in a manner explained below.

Figure 3:
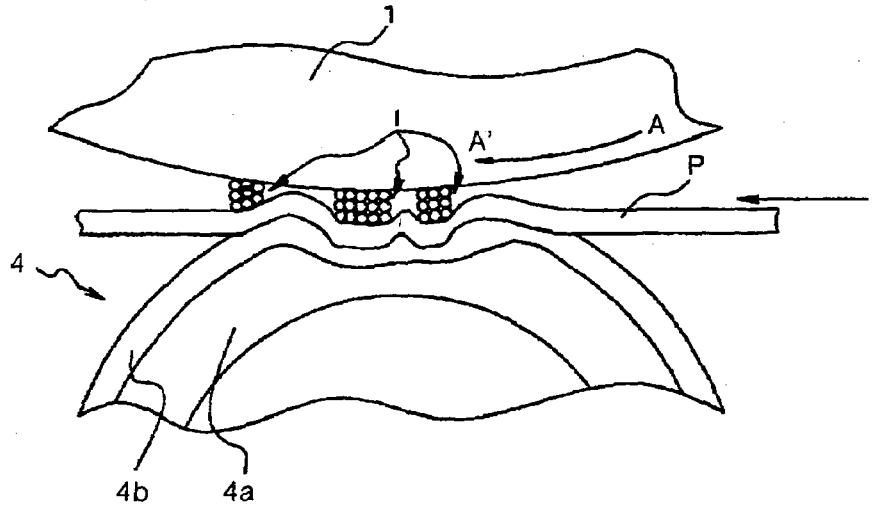
FIG. 3 is an enlarged schematic diagram of a transfer nip formed with a photosensitive element and a transfer roller that is pushed against it at sufficient pressure.

FIG. 3 is an enlarged schematic diagram of the transfer nip formed with the photosensitive element 1 and the transfer roller 4 that is pushed against it at sufficient pressure. As shown in FIG. 3, at the transfer nip where the transfer roller 4 is pushed against the photosensitive element 1 at a sufficient pressure, the first elastic layer 4*a* and the second elastic layer 4*b* of the transfer roller 4 are flexibly and elastically deformed. The transfer paper P is brought into contact with the surface layer of the toner image I carried on the surface of the photosensitive element 1, caused by the elastic deformation. The transfer paper P is also pushed so as to fit into a concave between adjacent toner images I, which allows a close contact between the surface of the photosensitive element 1 and the toner image I to be increased.

In order to obtain satisfactory close contact between the transfer paper P and the photosensitive element 1 at the transfer nip, at least the second elastic layer 4*b* is necessary to be set to the conditions, such as hardness: 30 to 60 degrees, and thickness: 1 millimeter or more. This allows the air gap formed between the photosensitive element 1 and the transfer paper P to be reduced and the transfer dust at the transfer nip or around the nip to be suppressed. Moreover, the transfer paper P can be thereby stably conveyed.

As shown in FIG. 3, the transfer roller 4 is pushed against the photosensitive element 1 at a pressure of 50 N/cm$^2$. Type 6200 manufactured by Ricoh Co., Ltd. is used as the transfer paper. By setting the pressure to 10 N/cm$^2$, the maximum height of the air gap increases even 20 micrometers. If the air gap is reduced to an adequate value by the sufficient transfer pressure (pushing force), the transfer dust can be efficiently suppressed. In the first embodiment, the transfer roller 4 is formed with the core metal and the two-layer elastic layer, but it is not limited thereby. Therefore, the transfer roller 4 may be a two-layer structure including a core metal and an elastic layer, or the elastic layer may include three layers.

Features of the present invention are explained below with reference to an example. At first, toner used in the example is explained.

Toner 1

How to obtain toner binder is explained first. Charged in a reaction vessel including a cooling pipe, a stirrer, and a nitrogen feed pipe were 724 parts by weight (hereinafter, "parts") of bisphenol A ethylene oxide 2 mol. adduct, 276 parts of isophthalic acid, and 2 parts of dibutyltin oxide. The mixture was reacted at 230° C. under ambient pressure for 8 hours, and the reaction was further continued for 5 hours at a reduced pressure of 10 mmHg to 15 mmHg and was cooled to 160° C. 32. parts of phthalic anhydride were added to the mixture reacted, and the mixture was reacted for 2 hours and was cooled to 80° C. 188. parts of isophorone diisocyanate were added to ethyl acetate, and the mixture was reacted for 2 hours to obtain an isocyanate-containing prepolymer. 267. parts of the isocyanate-containing prepolymer and 14 parts of isophoronediamine were reacted at 50° C. for 2 hours to obtain a urea-modified polyester having a weight average molecular weight of 64,000.

In the same manner as explained above, 724 parts of bisphenol A ethylene oxide 2 mol. adduct and 276 parts of isophthalic acid were charged in a reaction vessel including a cooling pipe, a stirrer, and a nitrogen feed pipe. The mixture was subjected to condensation polymerization at 230° C. under ambient pressure for 8 hours. The mixture was reacted for 5 hours at a reduced pressure of 10 mmHg to 15 mmHg to obtain non-modified polyester having a peak molecular weight of 5,000.

Next, 200 parts of the urea-modified polyester and 800 parts of the non-modified polyester were dissolved and mixed in 2,000 parts of a 1:1 mixed solvent of ethyl acetate and methyl ethyl ketone (MEK) to obtain a toner binder. A part of the toner binder obtained was dried under a reduced pressure to isolate a toner binder with an acid value of 10 at a glass transition temperature (hereinafter, "Tg") of 62° C.

A method of preparing toner is explained below. 240. parts of solution of the toner binder, 20 parts of pentaerythritol tetrabehenate (melting point: 81° C., melt viscosity 25 cps), 10 parts of carbon black were charged in a beaker, and were stirred using a TK-type homomixer at 60° C. at 12,000 rpm to dissolve and disperse the mixture uniformly, thereby obtaining a toner-material solution.

On the other hand, 706 parts of ion-exchanged water, 294 parts of a 10% hydroxyapatite suspension (Supertite 10, manufactured by Nippon Chemical Industrial Co., Ltd.), and 0.2 parts of sodium dodecylbenzenesulphonate were charged in a beaker and dissolved uniformly. The mixture was heated to 60° C., and the toner-material solution was added to the mixture with stirring at 12,000 rpm with a TK-type homomixer and the stirring was continued for another ten minutes. The mixture obtained was put into a flask with a thermometer where a stirring rod is provided, and heated to 98° C. to remove a part of the solvent. Then, the temperature of the mixture is cooled to the room temperature to be stirred at a speed of 12,000 rpm by the homomixer, and the toner is deformed from spherical shape to completely remove the solvent. Then, toner particles were filtered, washed, and dried to be air-classified, thereby obtaining mother toner particles. 100 parts of the toner particles and 0.5 parts of hydrophobic silica were mixed in a Henschel mixer to obtain the toner 1.

Toner 2

A method of obtaining toner binder used for preparing toner 2 is the same as that of the toner 1. However, the urea-modified polyester was changed from 200 parts to 250 parts, and the non-modified polyester was changed from 800 parts to 750 parts. A method of preparing the toner 2 is the same as that of toner 1.

Toner 3

Toner 3 is prepared in the following manner. 60. parts of polyester resin having a weight average molecular weight of 182,500 and Tg of 71° C., 27 parts of styrene-butyl acrylate copolymer having a weight average molecular weight of 105,000 and Tg of 58° C., 5 parts of carnauba wax, and 7 parts of carbon black #44 manufactured by Mitsubishi Kasei Corp. were kneaded at 130° C. using a biaxial extruder. Then, the substance kneaded were pulverized by a mechanical pulverizer and classified. 1.50. wt % of silica (R-972, Nippon Aerosil Co., Ltd.) was mixed therewith by the Henschel mixer to obtain the toner 3.

Mixed in each of the toner 1, the toner 2, and the toner 3 was carrier consisting of magnetite particles, having an average particle size of 50 micrometers and coated with methyl methacrylate resin (MMA) having a film thickness of 0.5 micrometer, so that toner density becomes 5.0 wt % to obtain three types of toner to be used in example 1 explained below.

EXAMPLE 1

Characteristics of the three types of toner were then measured. Methods of measurement thereof are explained below.

Measurement of Aggregation

Powder tester, PT-N type, manufactured by Hosokawa Micron Corp. was used as a measuring device. Although the method of measurement was basically performed by following the instruction of "Powder tester, PT-N type", some points were changed as follows.

1. Sieve used: 75 μm, 45 μm, 22 μm
2. Vibration time: 30 sec

Measurement of Average Circularity

Flow particle image analyzer FPIA-2100 manufactured by Sysmex Corp. was used as a measuring device for average circularity. At first, primary sodium chloride was used to prepare 1% NaCl aqueous solution, and it was filtered by a filter of 0.45 micrometer to obtain a liquid of 50 to 100 milliliters. The liquid was added with a surface active agent as a dispersant, preferably, 0.1 to 5 milliliters of alkyl benzene sulfonate, and further added with 1 to 10 milligrams of sample (toner). The resultant liquid was subjected to dispersion for one minute by an ultrasonic disperser to obtain a test sample with toner density such as particle density of 5,000 to 15, 000/μl. A diameter of a circle having area the same as area of a two-dimensional toner particle that was obtained by capturing the toner in the test sample by a CCD camera was determined as a diameter corresponding to the circle (hereinafter, "circle-corresponding diameter"). Toner particles of 0.6 micrometer or more based on the circle-corresponding diameter were used to calculate an average circularity as effective sample particles based on the pixel accuracy of the CCD. The average circularity is calculated in the following manner. At first, a perimeter of a circle having projected area the same as the area of a two-dimensional toner particle image, which is obtained using the CCD camera, is divided by a perimeter of the projected image to calculate circularity of each particle. Next, an accumulated value of the circularity of all the toner particles is divided by the number of all the toner particles to obtain the average circularity.

Measurement of Toner Particle Size

Coulter Multisizer lie was used to measure toner particle sizes. An aperture diameter was set to 100 micrometers. The results are shown below.

TABLE 1

| | Aggregation(%) | Circularity | Particle size |
|---|---|---|---|
| Toner-1 | 1.2 | 0.97 | 6.1 |
| Toner-2 | 3.4 | 0.92 | 6.3 |
| Toner-3 | 9.8 | 0.89 | 6.3 |

Devices used for the example 1 are explained below.

Test machine: A modified color laser printer (Imagio MF7070) manufactured by Ricoh Co., Ltd. had the same configuration as that of the image forming apparatus as shown in FIG. 1. The second elastic layer 4*b* of the transfer roller 4 was provided with a layer having a hardness of 50 degrees (Asker C, upon application of 1 Kg load), a thickness of 1.5 millimeters, and a volume resistivity of $9.1\times10^{10}$ Ω·cm. The transfer pressure was set to 104 N/cm$^2$. The developing conditions were as follows: developing potential: 400 volts, and background potential: 200 volts. The fixing conditions of the fixing device were as follows: surface pressure: 9.3 N/cm$^2$, and temperature: 185° C.

Comparison machine: The modified color laser printer (Imagio MF7070) manufactured by Ricoh Co., Ltd. was further modified to a machine whose transfer unit was replaced with a belt transfer system. A drive source was separately provided for the transfer unit and the photosensitive element so that a difference in speed would occur between the transfer unit and the photosensitive element. The rest of the configurations were the same as those of the printer. The transfer pressure was set to 20.4 N/cm$^2$.

As for the transfer bias of the test machine for each type of toner, a transfer ratio was checked by each 10 volts of transfer bias, and a condition under which the transfer ratio would be a maximum was set. The transfer ratio was obtained using the following method. A pattern chart of a black square having each side of 600 dots based on 600 dots per inch (dpi) was printed out. The developed pattern chart on the photosensitive element was transferred to the transfer paper. When the transfer paper was on the transfer conveyor belt, that is, before the toner was fixed on the transfer paper, the test machine was stopped. Only a portion, of the residual toner, corresponding to a black solid portion of the pattern chart was removed from the photosensitive element 1 using an adhesive tape or the like. The toner amount removed was measured and determined as a residual toner amount.

On the other hand, the amount of transfer toner transferred from the photosensitive element 1 to the transfer paper was obtained by cutting out a portion corresponding to the black solid portion of the transfer paper to measure a weight thereof as a first weight. The toner was blown off by compressed air, and a weight of the transfer paper as a second weight after the toner was blown off was measured. A value obtained by subtracting the second weight from the first weight was determined as the transfer toner amount. A value as a result of addition of the residual toner amount thus obtained and the transfer toner amount was determined as a total toner amount. The transfer ratio was obtained based on these toner amounts and the following relation equation.

$$\text{Transfer ratio}=(\text{transfer toner amount}/\text{total toner amount})\times 100 \quad (3)$$

The test machine and the toner were used to perform evaluation.

Evaluation of Transfer Dust

A ratio of transfer dust was obtained by using the following method. An image of a pattern chart of a black rectangle with a side in a main scanning direction of 600 dots based on 600 dpi and a side in a sub-scanning direction of 2 dots was printed out. The pattern chart printed out was read in 256 levels of gray and 5,000 dpi using a scanner, Nexscan 4100 manufactured by Hiderberg. The data read was binarized based on the density of 0.5 as a reference using a densitometer, X-Rite 938 manufactured by X-Rite Co. The total area of black dots apart from the black rectangle pattern was obtained to be determined as S1. The total area of all the black dots was determined as S2. A transfer dust ratio was determined based on these areas and the following relation equation.

$$\text{Dust ratio}=(S1/S2)\times 100 \quad (4)$$

The results were shown below.

TABLE 2

| | Transfer dust ratio | |
|---|---|---|
| | Test machine | Comparison machine |
| Toner-1 | 1.2% | 10.4% |
| Toner-2 | 1.6% | 12.8% |
| Toner-3 | 1.1% | 3.6% |

It is understood from the table that transfer dust occurs much less in the test machine according to the present invention as compared with the comparison machine. Particularly, the toner having low aggregation is extremely effective. This is because in the test machine, the transfer roller 4 was in contact with the photosensitive element 1 at high pressure, which allowed aggregation of toner particles to be enhanced at the transfer nip and allowed occurrence of the transfer dust to be suppressed. On the other hand, in the comparison machine, the transfer pressure was low, and a lot of transfer dust thereby occurred when the toner 1 and toner 2 having low aggregation were used.

Evaluation of Transfer Void

A ratio of voids occurring caused by insufficient transfer of a toner image to a transfer element (hereinafter, "transfer void ratio") was obtained using the following method. A pattern chart of a black rectangle with a side in a main scanning direction of 600 dots based on 600 dpi and a side in a sub-scanning direction of 40 dots was printed out. The pattern chart printed-out was binarized in the method. Area of white dots present in the black rectangle pattern was obtained from the image binarized to be determined as S3. The total area of all the black dots was determined as S2, and a transfer void ratio was determined based on these areas and the following relation equation.

$$\text{Transfer void ratio}=(S3/S2)\times 100 \quad (5)$$

The results are shown in Table 3.

TABLE 3

| | Transfer void ratio | |
|---|---|---|
| | Test machine | Comparison machine |
| Toner-1 | 0.1% | 0.1% |
| Toner-2 | 0.8% | 0.3% |
| Toner-3 | 4.8% | 0.1% |

It is understood from the results that the transfer void hardly occurred by using the toner having low aggregation even if the transfer pressure was high. Particularly, by using the toner 1 having an aggregation of 2% or less, occurrence of voids can be prevented.

Evaluation of Transfer Blur

A ratio of transfer blur was obtained by using the following method. The same pattern chart as that used for evaluation of transfer dust was used basically. However, in order to cause the transfer blur to easily occur, a pattern chart as follows was used. The pattern chart was obtained by filling, with black, all the portions away from the edges of the rectangle pattern by 600 dots or more in the main scanning direction. The pattern chart was output, and was binarized in the same manner as explained above. A branch line, which equally divides the black rectangle pattern into two portions in the main scanning direction, was drawn therein, and a portion passing through the transfer member before the branch line is determined as a front side, while a portion passing through the transfer member after the branch line is determined as a rear side.

The total area of the black dots that were present in an area on the front side, which was apart from the rectangle pattern, was determined as S4, while the total area of the black dots that were present in an area on the rear side, which was apart from the rectangle pattern, was determined as S5. If the transfer blur occurs, a toner image collapses in a radial direction with respect to the photosensitive element. Therefore, transfer dust increases upon transfer in either one area of the front side and the rear side based on the branch line as boundary. Therefore, the pattern chart was output 10 times to check whether a value between the maximum and the minimum in S4 or S5 increased or decreased by 30% or more. If so, it was regarded as occurrence of the transfer blur.

The results are shown in table 4.

TABLE 4

| | Transfer blur | |
|---|---|---|
| | Test machine | Comparison machine |
| Toner-1 | Not occurred | Occurred |
| Toner-2 | Not occurred | Occurred |
| Toner-3 | Not occurred | Not occurred |

It is understood from the results that the transfer blur did not occur in the test machine according to the present invention even if the toner with low aggregation was used. This is because the test machine made the transfer roller 4 follow rotation of the photosensitive element 1 and both of them rotate at an equal speed to each other, which did not cause transfer blur to occur even if the toner with low aggregation was used. In the comparison machine, on the other hand, even if the rotational speeds of the photosensitive element 1 and the transfer member were set to the same as each other, both of them did not always rotate at the same speed caused by torque of gear or the like, which resulted in occurrence of the transfer blur.

Evaluation was conducted on the transfer dust ratio, the void ratio, and the transfer blur by using the toner 1 and the test machine and changing the transfer pressure in the same manner as explained above. The results are shown in Table 5.

TABLE 5

| Transfer pressure(N/cm$^2$) | Transfer dust ratio | Void ratio | Transfer blur |
|---|---|---|---|
| 2 | 17.4% | 0.9% | occurred |
| 14 | 7.1% | 0.5% | occurred |
| 38 | 3.6% | 0.1% | Not occurred |
| 62 | 2.1% | 0.2% | Not occurred |
| 104 | 1.2% | 0.1 | Not occurred |
| 158 | 1.3% | 0.2 | Not occurred |
| 182 | 1.6% | 0.8% | Not occurred |
| 216 | 1.0% | 1.9% | Not occurred |

It is understood from the results that if the transfer pressure is lower than 20.4 N/cm$^2$, the transfer dust and the transfer blur occur. It is also understood that if the transfer pressure exceeds 200 N/cm$^2$, the void ratio increases.

In the first embodiment, the transfer roller 4 is pushed against the photosensitive element 1 at a transfer pressure of 20.4 N/cm$^2$ to 200 N/cm$^2$. By bringing the transfer roller 4 into contact with the photosensitive element 1 at a high pressure, friction force between these two increases, which causes these two to rotate together at the same speed. Consequently, the shearing force does not act on the tone layer between the photosensitive element 1 and the transfer roller 4, which allows the transfer blur to be suppressed. Furthermore, the transfer roller 4 is in contact with the photosensitive element 1 at a high pressure, which allows the aggregation of the toner particles to be increased at the transfer nip and occurrence of the transfer dust to be suppressed.

According to the first embodiment, the surface layer of the transfer roller 4 is an elastic layer having a thickness of 1 millimeter or more and a hardness of 30 to 60 degrees. As a result, a contact between the photosensitive element 1 and the transfer roller 4 becomes tighter, and the transfer roller 4 is made easily to rotate following the photosensitive element 1. Furthermore, a contact between a transfer paper and the photosensitive element 1 is made tighter. The transfer paper is held between the photosensitive element 1 and the transfer roller 4 and to which a toner image on the photosensitive element 1 is transferred. The tight contact allows an air gap formed between the photosensitive element 1 and the transfer paper to be reduced. Consequently, occurrence of transfer dust is suppressed, and the transfer paper can be stably conveyed.

According to the first embodiment, the transfer roller 4 is pushed against the photosensitive element 1 at a high pressure. Therefore, even if the toner having a low aggregation of 2% or lower is used, the transfer dust and the transfer blur are suppressed. Thus, a smooth halftone image with high quality is obtained.

Moreover, according to the first embodiment, the toner having an average circularity of 0.96 or higher is used. This allows occurrence of a void phenomenon, which tends to occur when the transfer roller 4 and the photosensitive element 1 are made to rotate at the same speed, to be suppressed and a high-quality image to be obtained.

Figure 4:
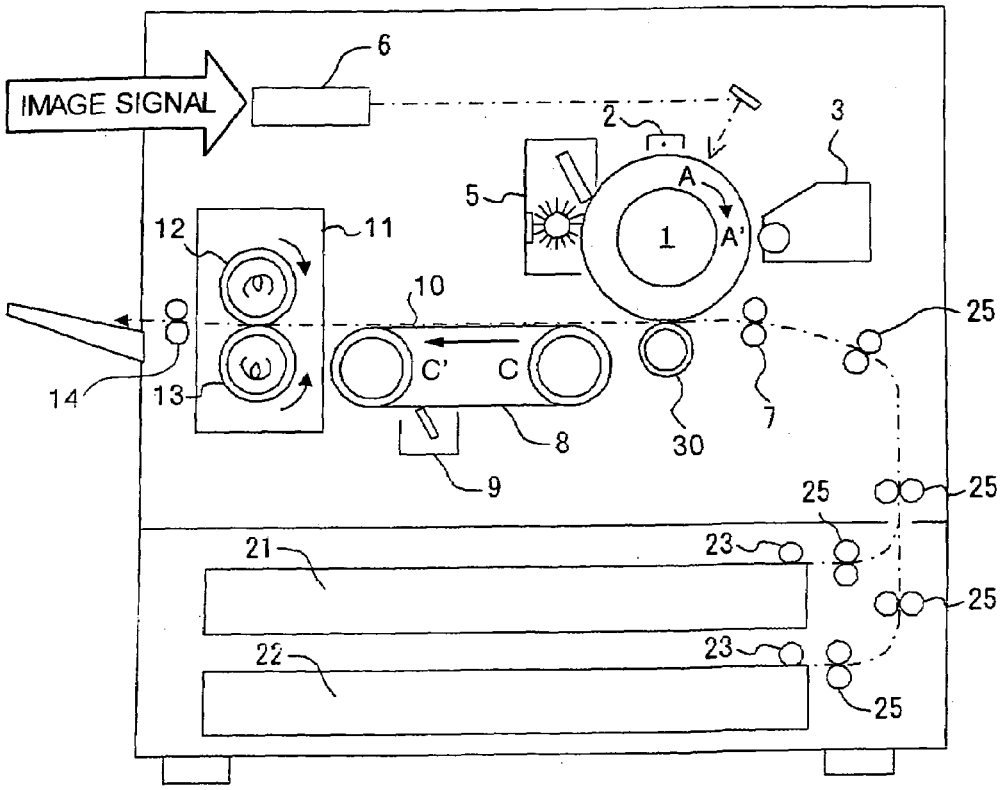
FIG. 4 is a schematic side view of an image forming apparatus according to a second embodiment of the present invention.

FIG. 4 is a schematic side view of an image forming apparatus according to a second embodiment of the present invention.

Figure 5:
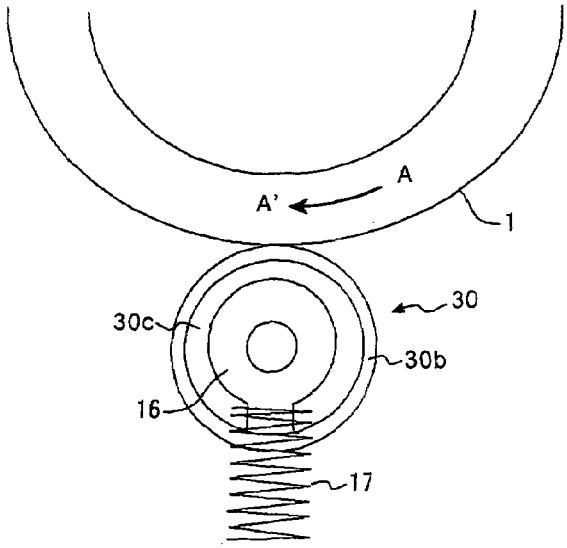
FIG. 5 is an enlarged schematic diagram of a transfer portion of the image forming apparatus.

FIG. 5 is an enlarged schematic diagram of a transfer unit of the image forming apparatus. The configuration of the transfer unit is explained below with reference to FIG. 5.

A transfer roller 30 includes a core metal 30*c*formed of aluminum, SUS, or Fe and having a diameter of 20 to 30 millimeters, and a solid-state elastic layer 30*b* formed of EPDM, silicon, NBR, or urethane provided over the core metal 30*c*. The elastic layer 30*b* has characteristics set to as follows: thickness: 0.1 to 3.0 millimeters, hardness (Asker C, upon application of 1 Kg load): 60 to 80 degrees, and volume resistivity: $1\times10^{7}$ to $1\times10^{11}$ Ω·cm. The most adequate range of surface resistivity is 1 to 2 digits higher than that of the volume resistivity. The transfer roller 30 is pushed against the photosensitive element 1 by the action of pushing force of a spring 17 toward the core metal 30*c* through a bearing 16.

The volume resistivity of the transfer roller 30 is better to employ a smaller value than the volume resistivity of a transfer element (or a transfer paper). By preferably using a transfer roller having a volume resistivity ranging from about 1/10 to 1/100 of that of the transfer element, the electric field applied to the transfer element is stabilized even under fluctuation in environment and degradation in the roller. Small resistance causes inconvenience as follows to occur. The inconvenience is such that a power source cannot apply bias according to the change in the transfer element or cannot supply bias stably.

The surface resistivity of the transfer roller 30 should be made higher than the volume resistivity. This allows toner to be transferred only by the action of the electric field in the same direction as that of the pressure. If the surface resistivity is lower than the volume resistivity, bias to be applied easily flows along the surface of the roller as is in the conventional transfer method using the belt. Thereby, the transfer efficiency of toner on the photosensitive element 1 worsens and the toner transferred easily moves over the transfer element, which causes the uneven toner or the blur. The present invention employed a roller of which surface resistivity was set to 10 to 100 times as high as the volume resistivity.

In the second embodiment, a dc power source (not shown) for application of transfer bias is connected between the core metal 30*c* of the transfer roller 30 and a conductive layer (base layer) of the photosensitive drum 1.

The term of "granularity or graininess" is generally regarded as an index of high image quality. The granularity that is a basic characteristic of an image quality is first explained below. Granularity is defined as "subjectively evaluated value for expressing how rough an image is, the image being supposed to be uniform". An objectively expressed amount of the granularity, which is the subjectively evaluated value, is an evaluation criteria of the granularity and a degree of the granularity. There is root-mean-square (RMS) granularity $\delta_D$ as standardized granularity, and measuring conditions are defined in ANSI PH-2. 40-1985.

The RMS granularity is expressed by the following equation.

$$\text{RMS granularity: } \delta D=[1/N\Sigma(Di-D)2]1/2 \quad (6)$$

Where Di is density distribution, and D is an average density (D=1/NΣDi).

There is another method of measuring granularity using a winner spectrum that is a power spectrum of fluctuation in density of an image. Dooley and Shaw of Xerox Co. Ltd. adopt the winner spectrum, for measurement of granularity of an electrophotographic image, which is cascaded with a visual transfer function (VTF) to be integrated, and determine a value as a result of integration as granularity (GS) (details: R. P. Dooley and R. Shaw, "Noise Perception in Electrophotography", Journal of Applied Photographic Engineering, Vol. 5, No. 4 (1979), pp. 190 to 196).

The granularity (GS) is expressed by the following equation.

$$GS=\exp(-1.8D)\int(WS(f))1/2VTF(f)df \quad (7)$$

Where D is an average density, f is a spatial frequency (c/mm), WS(f) is a winner spectrum, and VTF(f) is a visual transfer function. The term of exp(−1.8D) is a function with the average density D as a variable. The function is used to correct a difference between density and brightness that is perceived by human eye.

The "granularity" is further developed hereinafter from the "granularity" described by Dooley and Shaw, and defined by the following equation.

$$\text{Granularity}=\exp(aL+b)\int(WSL(f))1/2VTF(f)df \quad (8)$$

Where L is an average luminance, f is a spatial frequency (c/mm), WSL(f) is a power spectrum of fluctuation in luminance, and VTF(f) is a visual transfer function. Signs a and b are factors, and a=0.1044 and b=0.8944.

For the granularity, the density D of an image is not used but the luminance L (L*) is used. The latter is more excellent in linearity of color space and excellent in adaptability to a color image. The granularity is defined by the equation 8 (more details, see "Method of evaluating noise of a halftone color image" Japan Hardcopy '96 Proceedings, p. 189).

The granularity expresses noise characteristics of an image, which is clearly understood from the definition. By measuring the granularity of an output image using the method, the noise characteristics (roughness) of the image is obtained as numeric values. As for the numeric value of the granularity as understood from the definition, if the roughness is low, the value is small, while the value becomes larger as the roughness becomes higher. The inventers of the present invention calculated the granularity based on the computational equation after the output image was read by a scanner (Nexscan 4100 manufactured by Hiderberg).

As explained above, since the granularity is obtained based on an image after being fixed, fixing conditions in the second embodiment are described. In the explanation below, the granularity are obtained by using a fixing device that satisfies the fixing conditions.

In the fixing device 11 used, the fixing roller 12 and the pushing roller 13 are pushed against each other at a pushing force having a surface pressure of 9.3 N/cm$^2$ to form a fixing nip having a width of about 10 millimeters.

The fixing roller 12 is a roller (hardness on the shaft: 70 degrees) such that an aluminum core metal is coated with silicone rubber having a thickness of 300 micrometers (hardness of 25 degrees) and the silicone rubber is further covered with a Teflon tube of 20 micrometers. A halogen heater is arranged at the center of the core metal, and it is controlled by a sensor so that the surface of the roller becomes 190±50° C. The fixing roller 12 supplies heat to the toner image on the transfer element.

For the pushing roller 13, a roller is used such that an aluminum core metal is coated with silicone rubber having a thickness of 5 millimeters (hardness of 25 degrees) and the silicone rubber is further covered with a Teflon tube of 30 micrometers. The pushing roller 13 follows rotation of the fixing roller 12, and when the transfer element (toner image) passes through between the two rollers at about 350 mm/sec, the toner is heated and fused while being pressed. The toner image is output from the roller pair to be cooled, it is thereby fixed on the transfer element as a permanent image.

As a transfer device, the transfer roller 30 having an elastic layer on the surface of the aluminum core metal was used, and a speed ratio between the photosensitive element 1 and the transfer roller 30 was set to 0.95 to 1.05, which indicates transfer at equal speeds. The transfer paper was pushed at a predetermined pressure such as a transfer pressure of 1.0 N/cm$^2$ to 5.0 N/cm$^2$, and a transfer current during passage of the transfer paper was controlled so that a ratio as follows became 1.1 or less. The ratio is between dot area on the transfer element after an image with toner is transferred thereto (hereinafter, "dot area on the transfer element") and dot area on the photosensitive element after the image is developed with toner in a developing process (hereinafter, "dot area on the photosensitive element").

As for developing conditions, toner in developer having an average particle size ranging from 4.0 to 7.0 micrometers and an average circularity of 0.9 or more was used. By performing development with a developing gap of 0.3 to 0.5 millimeters in a developing device used at this time, a developing bias, a developer carrier, and some other conditions were selectively controlled so that an amount of toner development (hereinafter, "amount of development") on the photosensitive element after the image passed through the developing process became 0.5 mg/cm$^2$ or less.

In the transfer unit, a current to be applied to the transfer roller is set to a value near an inflection point of the current based on a relation between a roller bias and a transfer current typified with reference to FIG. 9 as explained later. By thus setting the current, a current to be applied is adequately controlled to such a current that is not more than a current that leaks from the transfer element held by the transfer roller 30 and the photosensitive element 1 and that is not less than a current at which electrostatic transfer is possible.

It is also adequate to use insulated toner of which aggregation is 20% to 50% and volume resistivity is $1\times10^9$ Ω·cm or higher.

The transfer roller 30 is pushed against the photosensitive element 1 to thereby transfer the toner on the photosensitive element 1 to the transfer paper that is conveyed in synchronism to the photosensitive element 1. At this time, it is important to transfer the toner thereto at a pushing force stronger than that of the ordinal (conventional) electrostatic transfer and in an electric field according to a set pushing force (weaker than the ordinal electrostatic transfer) such that the dot area on the photosensitive element 1 does not spread.

Figure 6:
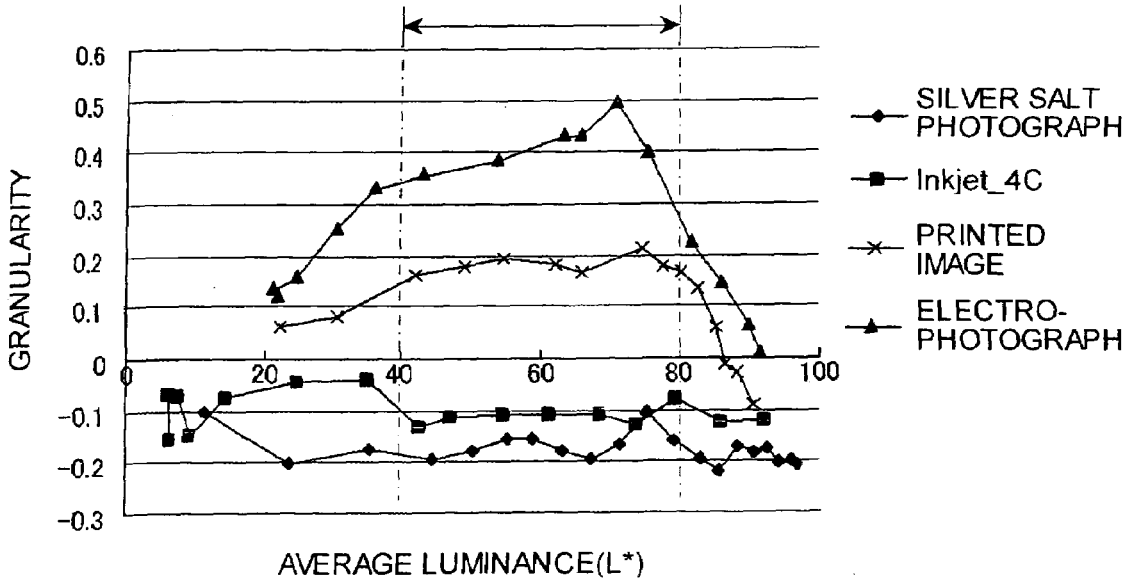
FIG. 6 is a graph for explaining granularities of images obtained by using image forming methods.

FIG. 6 is a graph for explaining granularities of images obtained by using image forming methods. The x-axis plots average luminance and the y-axis plots granularity. The granularity was provided for each luminance. The luminance was taken up as samples in 15 levels for experiments (A patch with 15 levels was prepared. The patch had 106 lines as screen-lines, which were subjected to dithering. See FIG. 7) and the granularity was calculated for each luminance.

As explained above, the granularity is plotted for each luminance, and therefore, the granularities plotted are output as a graph. As is apparent from the pattern for measurement of the granularity (FIG. 7), a smaller value of the luminance indicates an image closer to a solid image. While a larger value of the luminance indicates a small dot area, almost all of which indicates a toner carrying element (paper). In other words, the roughness of the image is low in this dot area. In the electrophotography, particularly, in the method of using powder toner, fluctuations in toner size, dust around toner dots, and the like cause the granularity to increase, and the texture of roughness to be quite noticeable at the luminance of 40 to 80 (a range indicated by both arrows in FIG. 6). In order to obtain the granularity as numeric values, by handling the granularity with an average value ranging 40 to 80 as an average luminance that is visually highly sensitive, the virtues of the image can be expressed clearly.

As shown in FIG. 6, a change in a silver salt photograph and an image by ink jet printing is not so large with respect to the luminance. This is because the image is provided with a colorant that is ink as liquid or with ultrafine particles as silver salt. In a printed image formed with dots and toner having a particle size of 7 micrometers or more, fluctuations in shape of dots and a dust phenomenon due to toner transfer occur in an electrophotographic method using toner. The average luminance of 40 to 80 causes high (bad) granularity. The fluctuations and the dust phenomenon are particularly large amounts in the electrophotographic method. Therefore, evaluation of an image based on the granularity at the average luminance of 40 to 80 is the best index of high image quality in the electrophotographic method using dry toner.

As a measure of a numeric value of image granularity, the granularity within about 0.25 is adequate for smoothness at the least distance of distinct vision. More preferably, if an image has granularity of 0.15 or lower that is the level required for offset printing in which an image is formed with dots as well, then the image has the same level as that of a printed matter.

In the present invention, in order to achieve an object such that the image granularity is suppressed to 0.25 or lower, the transfer roller 30 (applied with bias) and the developing conditions as follows are provided. That is, the transfer roller 30 is configured so that a ratio between the dot area on the transfer element and the dot area on the photosensitive element 1 is 1.1 or less. The developing conditions are such that the height of toner on the photosensitive element 1 after an image is developed with the toner in the developing process is three times or less than the average toner particle size. Thus, the granularity of the dot image is suppressed to 0.25 or lower.

Figure 8A:
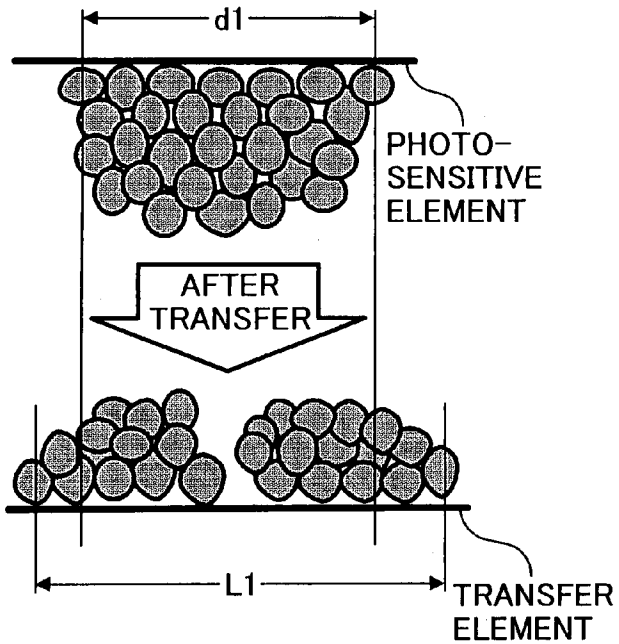
FIG. 8A to FIG. 8C are schematic diagrams of toner particles before and after toner images are transferred based on comparison between the present invention and the conventional technology.
Figure 8B:
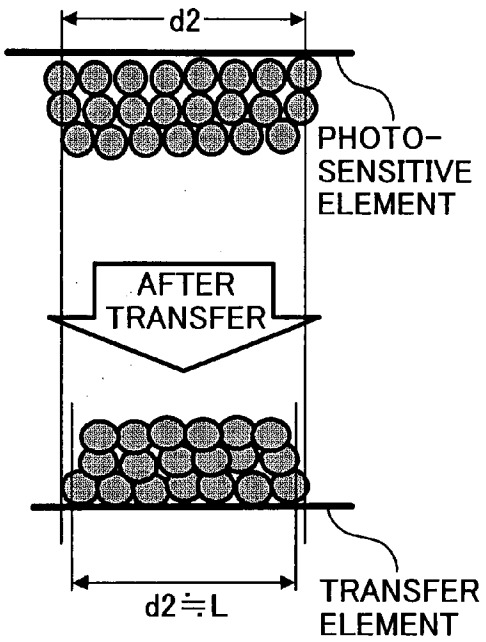
Figure 8C:
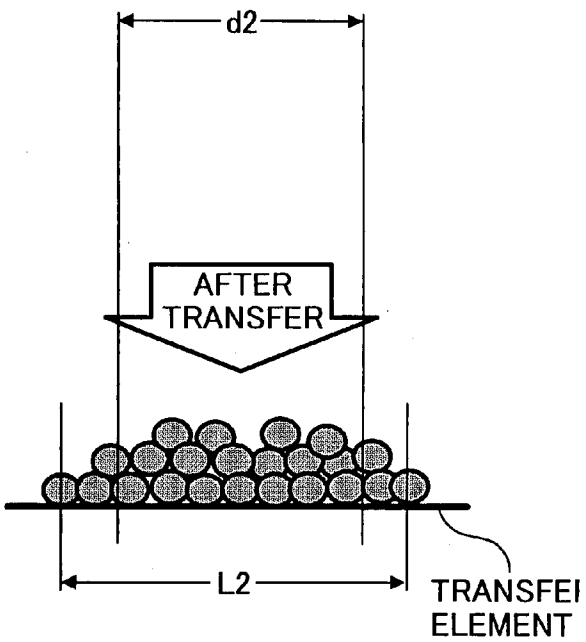

FIG. 8A to FIG. 8C are schematic diagrams of images with toner particles before and after being transferred to transfer elements based on comparison between the present invention and the conventional technology. FIG. 8A is a schematic diagram of a toner image on the photosensitive element 1 after an image is developed (hereinafter, "after the development") and a toner image after the toner image is transferred to the transfer element (hereinafter, "after the transfer"). based on the conventional technology. The toner is irregular-shaped toner having a particle size of 8 micrometers. In order to ensure image density, the amount of development is equivalent to about four layers, i.e., about 0.75 mg/cm$^2$. About five layers of toner for the image after being developed are piled on the photosensitive element 1, and the transfer roller 30 is pushed at about 0.4 N/cm$^2$ in the transfer unit. However, the pressure applied to the toner is higher at the central portion than the edge portions, which causes a phenomenon such as a void without toner upon transfer (transfer void) to occur. Moreover, because there is a necessity to ensure transfer efficiency, the transfer current is set to 1.5 μA/cm, and discharge thereby occurs upon transfer (this phenomenon is explained later with reference to FIG. 9). By the discharge, a phenomenon such as scattering of toner at the edges occurs. As a result, the ratio (the widths L1/d1 of the images in FIG. 8A) between the dot area on the transfer element and the dot area on the photosensitive element is widened to about 1.15 to 1.20.

The about five layers correspond to a thickness of about five times as thick as the toner particle size. In other words, the about five layers of toner having a particle size of 8 micrometers correspond to a thickness of about 40 micrometers. Hereinafter, a thickness of toner after being developed on the photosensitive element is evaluated by using the number of layers.

FIG. 8B is a schematic diagram of toner images before and after the transfer according to the present invention. A spherical toner having a particle size of 4 micrometers is used in this second embodiment. The developing conditions are those following the present invention, and the toner image on the photosensitive element 1 has about three layers aligned, and the amount of development at this time is about 0.5 mg/cm$^2$. As is apparent from FIG. 8B, the image is developed to be flatter than that of the conventional technology, and therefore, even if the transfer pressure is increased to about 4 N/cm$^2$, the transfer void does not occur. Moreover, setting the transfer pressure to slightly high and setting the amount of development to slightly low allow the transfer current to be set to 1 μA/cm that is lower than the conventional technology without decrease in the transfer efficiency. Therefore, the ratio (L/d2 in FIG. 8B) between the dot area on the transfer element and the dot area on the photosensitive element is about 1.0, which indicates no toner spread during the transfer process.

FIG. 8C is a schematic diagram of a toner image after the transfer according to a reference example, in which transfer conditions are different from these in FIG. 8B. In the reference example, the current applied to the transfer roller 30 is increased to 2 μA/cm. Although the transfer efficiency slightly increases from 85% to 87%, discharge occurs, which causes dust of toner to occur at the edges in the toner image of FIG. 8C. The transfer dust of toner at the edges is caused by a leak phenomenon upon transfer explained later.

The material of the surface layer of the transfer roller 30 is a hard elastic material. It is important that usable toner is restricted to small-sized and spherical toner. The surface of the transfer paper is a fibrous material in which fibers are intertwined with one another, and therefore, the surface has irregularities, and moreover, the irregularities are not even. By observing, for example, Type 6000 transfer paper (manufactured by Ricoh Co., Ltd.) usually used, it is found that the surface thereof has irregularities of about 40 micrometers. From the micro viewpoint, a portion of the conveyed transfer paper in contact with the photosensitive element 1 is only the convex portion, and the concave portion is apart from the photosensitive element 1. On the other hand, the toner particle size is generally about 6 micrometers, which is about one seventh as compared with an air gap (40 micrometers) at the concave portion. Therefore, toner that faces the concave portion does not contact the transfer paper, and the action of the stronger (higher) electric field than that of the convex portion is needed in order to transfer the toner from the photosensitive element 1 to the transfer paper.

Conventionally, the transfer is performed in such a state as explained above, and peel discharge thereby occurs when the transfer paper is separated from the photosensitive element 1 after the transfer, which causes "the transfer dust, the uneven toner, and the blur" to occur. Such a discharge also occurs right before the transfer paper comes in contact with the photosensitive element. Therefore, it is important to weaken the transfer electric field in order to improve the image quality upon transfer. This discharge occurs toward between the concave portion and the photosensitive element 1 (if N/P: negative-positive, mainly a non-image portion), toward the convex portion, or toward the concave portion. Therefore, the toner at the position to be transferred moves toward a discharge direction (disturbance of transfer), which causes "the transfer dust, the uneven toner, and the blur" to occur.

Figure 9:
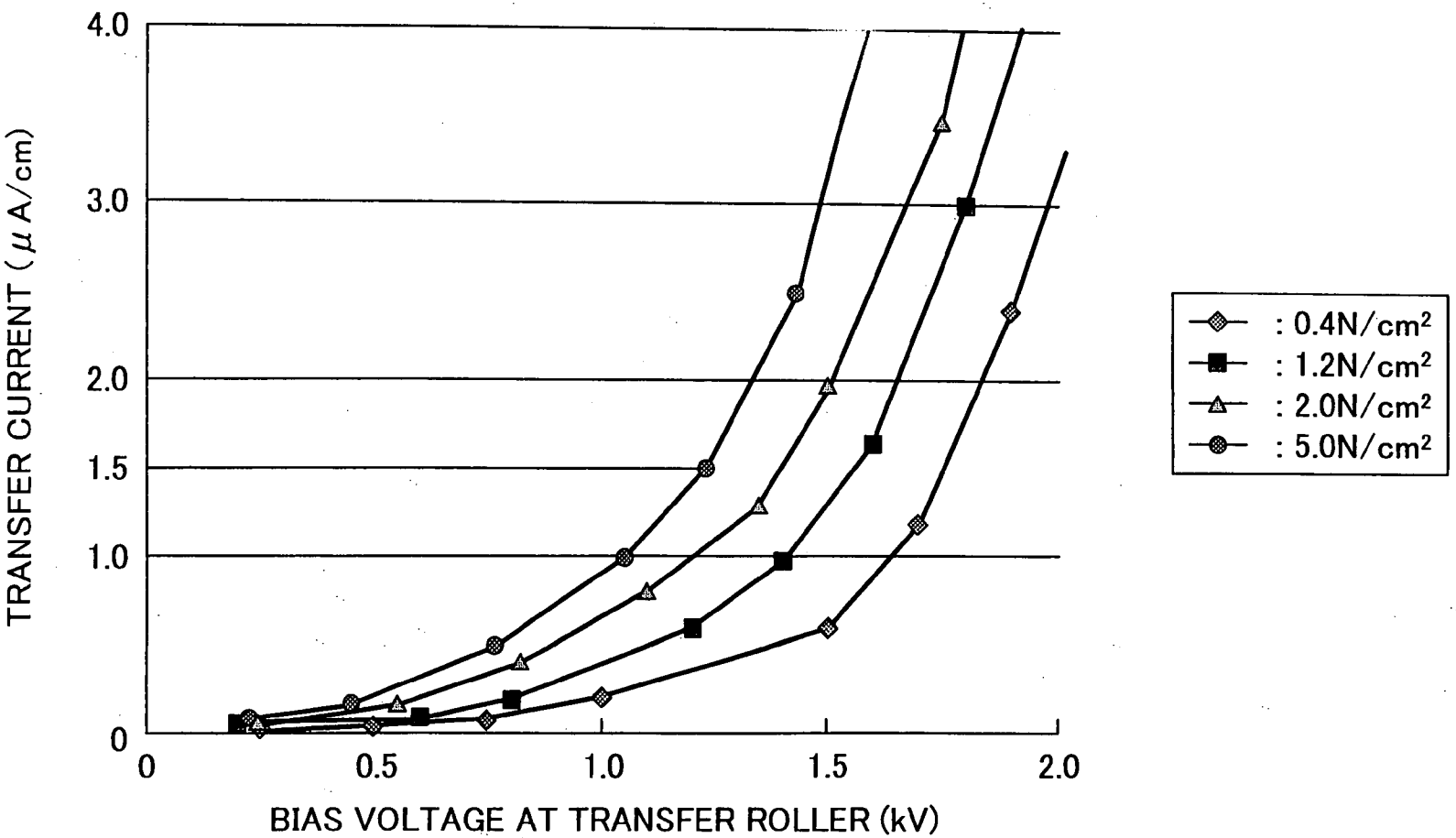
FIG. 9 is a graph for explaining a relation between a bias voltage and a current for transfer when transfer pressures are made different.

FIG. 9 is a graph for explaining a relation between a bias voltage and a current for transfer when transfer pressures are made different. As shown in this figure, a current passing through the transfer paper upon transfer includes four types having different transfer pressures. Increase in the transfer pressure allows the current with respect to the voltage to increase. This is caused by the reason as explained above. By further increasing the voltage to, for example, 5 N/cm$^2$, the current sharply increases at around a portion where the current exceeds 1.5 μA/cm. This voltage is a leak start (or causing) voltage. In other words, a leak phenomenon occurs because the voltage exceeds the value under which the charge cannot be held in the transfer paper. The toner after being transferred flies off toward a direction of leak of the current, and therefore, the toner is transferred in any direction irrespective of its original transfer direction.

Although the leak-causing voltage is slightly reduced by increasing the transfer pressure, it does not change much because it largely depends on the type of transfer paper. Therefore, the leak is independent on the voltage. The charge (current) is more important than the voltage to ensure the transfer efficiency. Therefore, a current of about 1.5 μA/cm to about 2.0 μA/cm is required at the transfer pressure of about 0.4 N/cm$^2$ or less in the conventional technology. Accordingly, the current is included in the leak range, which causes toner dust to occur.

Based on such a transfer mechanism, the present invention provides an image with high quality. The image is obtained by increasing a pushing force (pushing force of the transfer roller 30 against the photosensitive element 1) so that the transfer electric field can be weakened without decrease in the transfer efficiency and by using both the pushing force increased and improved toner particles that prevent image degradation due to the high pushing force. Consequently, the image obtained is free from the transfer void, the transfer dust, the uneven toner, and the blur.

It is also adequate that the toner having high aggregation, which is highly resistant to the toner dust upon peel discharge, is used. When the toner particles that have physically strong binding capacity are bound to one another under the pressure and electrostatic force, the toner particles having been once transferred hardly move again even if the peel discharge occurs, which allows the advantageous effects of the present invention due to a combination of such toner particles with high pushing force to be further exhibited.

Use of the transfer pressure higher than the conventional pushing force allows a contact portion between the convex portion of the transfer paper and the photosensitive element to increase. An apparent dielectric thickness ($dp/\in p$) and an air gap of the transfer paper are thereby narrowed, which makes it possible to suppress a voltage to be applied (to obtain the same electric field effect). However, all the air gaps at the concave portions have not always been resolved perfectly, and therefore, the aggregation of toner particles is also used to allow suppression of the voltage to be applied.

Insulated toner having high resistance is employed to maintain transfer performance in a weak electric field.

The transfer roller 30 may be formed of a rigid material in order to make high transfer pressure possible. However, the portion of the transfer paper in contact with the transfer roller 30 has also irregularities, and therefore, it is adequate that the transfer roller is formed with an elastic material capable of fitting along the irregular surface of the transfer paper while sufficient pushing force is maintained so that the stress can be dispersed and the transfer paper can be uniformly pushed.

Employment of the toner having high aggregation allows adhesion force of toner to the photosensitive element 1 to increase not only between toner particles but also between toner and the photosensitive element or between toner and transfer paper. Therefore, by reducing the surface resistivity of the photosensitive element 1 to cause releasability of toner to increase, the transfer performance can be improved.

As is apparent from the graph of FIG. 9, the transfer paper is charged together with increased bias voltage, and when the bias voltage exceeds a limit voltage, the current passing though the transfer paper abruptly rises. The current at a limit point is about 1.5 μA/cm if the transfer pressure is about 5 N/cm$^2$. The limit point is an upper limit value of a charged amount allowable by the transfer paper. If a current exceeds the upper limit value of the charged amount caused by the increased bias voltage, the current leaks toward the photosensitive element 1 through the transfer paper.

In other words, it is verified that the current more than the leak current affects the charge of the toner on the photosen sitive element 1 or causes peel discharge. On the other hand, the transfer efficiency gets worse at the limit point as a peak. However, there is a phase delay due to a linear velocity of the device, and an actual peak is in current values that exceed the limit point. Therefore, it is common that the current is set to a value 1.2 to 1.5 times or more the leak value in the conventional technology. Moreover, the limit point changes caused by the transfer pressure, the type of transfer paper, or the environment. Therefore, conventionally, in order to obtain satisfactory transfer efficiency even if the limit point is changed, the actual current is commonly set to a value 1.5 to 2 times the limit point because of complicity of control.

The inventors of the present invention have found the fact that a leak of a bias current from the transfer paper and an area to which a current more than the leak current is applied are one of causes of the toner dust, the uneven toner, the blur upon transfer, and that this area is an area where peel discharge occurs. They have noted that the transfer pressure (pushing force of the transfer roller 30 to the photosensitive element 1) should be increased, which cannot be thought of in a conventional electrostatic transfer system. By increasing the transfer pressure, it is possible to obtain both, excellent transfer efficiency at a current area more than the limit point and suppression of spreading of dots after the transfer, and achieve granularity of 0.25 or lower. A range of about +20% to −40%; including a leak start current, can be the most adequate current range in consideration of the phase delay. If the range is more than that, transfer dust and blur occur, while if the range is less than that, the transfer efficiency gets worse, which does not allow satisfactory transfer performance to be ensured even if the transfer pressure is increased.

If the hardness of the transfer roller 30 is low, a required transfer pressure is not obtained. In order to achieve the high transfer pressure that is one of features of the present invention, a roller hardness may be 50 degrees or more. If the hardness exceeds 80 degrees, the transfer roller cannot fit along the irregular surface of the transfer paper, which causes the transfer roller not to push it uniformly.

As a thickness of the elastic layer 30*b* of the transfer roller 30, about 10 times, preferably, 5 times a deformed amount due to pressure is required. If the thickness of the elastic layer 30*b* is made thinner, the roller hardness defined in the present invention cannot practically be obtained caused by the influence of the roller core metal 30*c*. By making the elastic layer 30*b* thicker, it is possible to obtain required hardness. However, the volume resistivity of the transfer roller 30 practically increases, and a voltage applied as a transfer bias also rises, which causes the risk of occurrence of leak to increase. Known elastic materials can be used for the elastic layer 30*b* if the roller hardness and other values such as volume resistivity are within the range in which the present invention is executable. The thickness thereof is approximately 3 millimeters at a maximum.

Toner usable in the present invention is explained below.

The aggregation of toner particles is preferably high to some extent, and ranges from 20% to 50%, more preferably, from 30% to 40%. If the aggregation of toner particles is too low, individual toner particles easily move. Therefore, if the peel discharge occurs upon transfer, the toner particles move along the disturbance of the electric field, which causes the transfer dust, the uneven toner, the blur to easily occur. If the toner aggregation is high, toner particles strongly attract each other, which causes the adhesion force of the toner to the photosensitive element to increase and transfer efficiency to get worse. Therefore, toner aggregation such that adhesion of toner to the photosensitive-element is not weakened is determined as an upper limit, which allows the advantageous effects of the present invention to exhibit. The aggregation of the toner particles can be expressed as aggregation (%). If the value of aggregation is larger, the aggregation of toner particles is stronger.

The four types of currents passing through the transfer paper during the transfer based on different transfer pressures are shown in FIG. 9. The graph depicts the results of measuring a current and a voltage by starting the dc current when the transfer paper is passed through between the photosensitive element 1 and the transfer roller 30, using the laser printer as shown in FIG. 4.

The method of measuring aggregation is explained below.

Measuring device: Powder tester, PT-N type, manufactured by Hosokawa Micron Corp.

Operating method: Based on the instructions of "Powder tester, PT-N type" except for some points as follows. Modified points: (1) Sieve used: 75 μm, 45 μm, and 22 μm, and (2) Vibration time: 30 sec.

The volume resistivity of the toner used in the present invention is preferably $1\times10^{9}$ Ω·cm or more. If the volume resistivity is not more than the value, the transfer efficiency gets worse, and the image quality thereby deteriorates, and therefore, the value is not adequate. The volume resistivity of toner is measured by applying a load of 6 t/cm$^2$ to 3.0-gram toner to form a disk-shaped pellet having a diameter of 40 millimeters and measuring the pellet by Dielectric loss measuring set TR-10C (manufactured by Ando Electric Co., Ltd.). The frequency is 1 kilohertz, and the ratio is $11\times10^{-9}$.

For a binder resin of toner, any known resin can be used. For example, it includes styrene, poly-α-steel styrene, ethylene-ethyl acrylate copolymer, xylene resin, and polyvinyl butyrate resin.

For a parting agent, all the known agents can be used. Particularly, de-free fatty acid carnauba wax, montan wax, and rice wax oxide can be used singly or in combination.

For an external additive, inorganic particles can be preferably used. A specific example of the inorganic particles includes silica, alumina, titanium oxide, barium titanate, magnesium titanate, calcium titanate, calcium carbonate, silicon carbide, and silicon nitride.

A charge control agent may be contained in toner if necessary. All the known agents can be used as the charge control agent. Examples thereof include nigrosine dye, triphenylmethane dye, fluorine active agent, salicylic acid metal salt, and metal salt of salicylic acid derivative.

For a colorant, all the pigments and dyes conventionally used as toner colorant can be used. Examples thereof include carbon black, lamp black, iron black, ultramarine blue, nigrosine dye, aniline blue, chalco oil blue, oil black, and azo oil black, but the selection is not particularly limited thereto.

A method of manufacturing toner may be any of the known methods. The binder resin, the magnetic material, the parting agent, and the colorant, and the charge control agent if necessary are mixed by a mixer, and are kneaded by a kneader such as a heat roller or an extruder to be cooled and solidified. The mixture solidified is pulverized by a pulverizer such as a jet mill, a turbo jet mill, and Cryptron, and classified. A mixer such as a Super mixer or a Henschel mixer is used to add inorganic powder or fatty acid metal salt to the toner.

Eight examples as specific examples of toner are explained below.

| Toner No. 1 | |
|---|---|
| Polyester resin (weight average molecular weight: 310,000, Tg: 65° C.) | 44 parts |
| Styrene-n-butyl acrylate copolymer (weight average molecular weight: 85,000, Tg: 68° C.) | 40 parts |
| Carnauba wax | 5 parts |
| Carbon black (# 44: Mitsubishi Chemical Corp.) | 10 parts |
| Charge control agent (Spiron black TR-H: Hodogaya Chemical Co., Ltd.) | 1 part |

The mixture was kneaded at 130° C. using a biaxial extruder, and pulverized by a mechanical pulverizer to be classified to obtain a weight average particle size of 7.0 micrometers, and 0.2 wt % of silica (R-972: Nippon Aerosil Co., Ltd.) was mixed therewith by a Henschel mixer to obtain the toner. The hardness of the toner was 8 degrees, the aggregation was 45%, and the volume resistivity was $8.5\times10^{9}$ Ω·cm.

| Toner No. 2 | |
|---|---|
| Polyester resin (weight average molecular weight: 185,000, Tg: 67° C.) | 71 parts |
| Carnauba wax (average particle size: 300 μm) | 3 parts |
| Triion tetroxide (EPT-1000: Toda Kogyo Corp.) | 15 parts |
| Carbon black (# 44: Mitsubishi Chemical Corp.) | 10 parts |
| Charge control agent (Spiron black TR-H: Hodogaya Chemical Co., Ltd.) | 1 part |

The mixture was kneaded at 160° C. using the biaxial extruder, and pulverized by the mechanical pulverizer to be classified to obtain a weight average particle size of 5.5 micrometers, and 1.0 wt % of silica (R-972: Nippon Aerosil Co., Ltd.) was mixed therewith by the Henschel mixer to obtain the toner. The hardness of the toner was 11 degrees, the aggregation was 8.0%, and the volume resistivity was $5.5\times10^{8}$Ω·cm.

| Toner No. 3 | |
|---|---|
| Styrene/n-butyl methacrylate/2-ethyl hexyl acrylate copolymer (composition ratio: 75/10/15, weight average molecular weight: 210,000, Tg: 57° C.) | 55 parts |
| Polyester resin (weight average molecular weight: 160,000, Tg: 64° C.) | 23 parts |
| Polyethylene wax (molecular weight: 900) | 10 parts |
| Carbon black (# 44: Mitsubishi Chemical Corp.) | 10 parts |
| Charge control agent (Spiron black TR-H: Hodogaya Chemical Co., Ltd.) | 2 parts |

The mixture was kneaded at 90° C. using the biaxial extruder, and pulverized by an air flow pulverizer to be classified to obtain a weight average particle size of 5.0 micrometers, and 0.2 wt % of silica (R-972: Nippon Aerosil Co., Ltd.) was mixed therewith by the Henschel mixer to obtain the toner. The hardness of the toner was 6 degrees, the aggregation was 55%, and the volume resistivity was $8.8\times10^{9}$ Ω·cm.

| Toner No. 4 | |
|---|---|
| Polyester resin (weight average molecular weight: 274,000, Tg: 68° C.) | 79 parts |
| Polyethylene wax (molecular weight: 900) | 3 parts |
| Carbon black (# 44: Mitsubishi Chemical Corp.) | 15 parts |
| Charge control agent (Spiron black TR-H: Hodogaya Chemical Co., Ltd.) | 3 parts |

The mixture was kneaded at 150° C. using the biaxial extruder, and pulverized by the air flow pulverizer to be classified to obtain a weight average particle size of 9.5 micrometers, and 1.0 wt % of silica (R-972: Nippon Aerosil Co., Ltd.) was mixed therewith by the Henschel mixer to obtain the toner. The hardness of the toner was 14 degrees, the aggregation was 20%, and the volume resistivity was $4.2\times10^{7}$ Ω·cm.

| Toner No. 5 | |
|---|---|
| Polyester resin (weight average molecular weight: 310,000, Tg: 65° C.) | 49 parts |
| Styrene-n-butyl acrylate copolymer (weight average molecular weight: 85,000, Tg: 68° C.) | 35 parts |
| Carnauba wax | 4 parts |
| Carbon black (# 44: Mitsubishi Chemical Corp.) | 10 parts |
| Charge control agent (Spiron black TR-H: Hodogaya Chemical Co., Ltd.) | 2 parts |

The mixture was kneaded at 130° C. using the biaxial extruder, and pulverized by the mechanical pulverizer to be classified to obtain a weight average particle size of 8.5 micrometers, and 0.75 wt % of silica (R-972: Nippon Aerosil Co., Ltd.) was mixed therewith by the Henschel mixer to obtain the toner. The hardness of the toner was 10 degrees, the aggregation was 15%, and the volume resistivity was $9.5\times10^{8}$ Ω·cm.

| Toner No. 6 | |
|---|---|
| Polyester resin (weight average molecular weight: 185,000, Tg: 67° C.) | 73 parts |
| Carnauba wax (average particle size: 300 μm) | 5 parts |
| Triion tetroxide (EPT-1000: Toda Kogyo Corp.) | 10 parts |
| Carbon black (# 44: Mitsubishi Chemical Corp.) | 10 parts |
| Charge control agent (Spiron black TR-H: Hodogaya Chemical Co., Ltd.) | 2 parts |

The mixture was kneaded at 160° C. using the biaxial extruder, and pulverized by the mechanical pulverizer to be classified to obtain a weight average particle size of 5.0 micrometers, and 1.0 wt % of silica (R-972: Nippon Aerosil Co., Ltd.) was mixed therewith by the Henschel mixer to obtain the toner. The hardness of the toner was 11 degrees, the aggregation was 41%, and the volume resistivity was $9.8\times10^{8}$ Ω·cm.

| Toner No. 7 | |
|---|---|
| Polyester resin (weight average molecular weight: 310,000, Tg: 65° C.) | 56 parts |
| Styrene-n-butyl acrylate copolymer (weight average molecular weight: 85,000, Tg: 68° C.) | 35 parts |

-continued

| Toner No. 7 | |
|---|---|
| Carnauba wax | 3 parts |
| Carbon black (# 44: Mitsubishi Chemical Corp.) | 5 parts |
| Charge control agent (Spiron black TR-H: Hodogaya Chemical Co., Ltd.) | 1 part |

The mixture was kneaded at a low temperature of 80° C. using the biaxial extruder, and pulverized by the mechanical pulverizer to be classified to obtain a weight average particle size of 8.5 micrometers, and 1.0 wt % of silica (R-972: Nippon Aerosil Co., Ltd.) was mixed therewith by the Henschel mixer to obtain the toner. The hardness of the toner was 10 degrees, the aggregation was 25%, and the volume resistivity was $3.5\times10^{7}$ Ω·cm.

| Toner No. 8 | |
|---|---|
| Polyester resin (weight average molecular weight: 310,000, Tg: 65° C.) | 56 parts |
| Styrene-n-butyl acrylate copolymer (weight average molecular weight: 85,000, Tg: 68° C.) | 35 parts |
| Carnauba wax | 3 parts |
| Carbon black (# 44: Mitsubishi Chemical Corp.) | 5 parts |
| Charge control agent (Spiron black TR-H: Hodogaya Chemical Co., Ltd.) | 1 part |

The mixture was kneaded at a low temperature of 80° C. using the biaxial extruder, and pulverized by the mechanical pulverizer to be classified to obtain a weight average particle size of 4.0 micrometers, and 1.0 wt % of silica (R-972: Nippon Aerosil Co., Ltd.) and 0.20 wt % of stearic acid zinc powder were mixed therewith by the Henschel mixer to obtain the toner. The hardness of the toner was 10 degrees, the aggregation was 35%, and the volume resistivity was $1.8\times10^{9}$ Ω·cm.

Eight types of toner characteristics are given in the following table 6.

TABLE 6

| Type of toner | Hardness | Aggregation | Volume resistivity | Particle size |
|---|---|---|---|---|
| toner No 1 | 8 Degrees | 45% | 8.5 × 10E9 Ωcm | 7.0 μm |
| toner No 2 | 6 Degrees | 8% | 5.5 × 10E8 Ωcm | 5.5 μm |
| toner No 3 | 11 Degrees | 55% | 8.8 × 10E9 Ωcm | 5.0 μm |
| toner No 4 | 14 Degrees | 20% | 4.2 × 10E7 Ωcm | 9.5 μm |
| toner No 5 | 10 Degrees | 15% | 9.5 × 10E8 Ωcm | 8.5 μm |
| toner No 6 | 11 Degrees | 41% | 9.8 × 10E8 Ωcm | 5.0 μm |
| toner No 7 | 10 Degrees | 25% | 3.5 × 10E7 Ωcm | 8.5 μm |
| toner No 8 | 10 Degrees | 35% | 1.8 × 10E9 Ωcm | 4.0 μm |

A method of evaluating transfer efficiency and transfer dust is explained below.

A test machine was Imagio MF7070 manufactured by Ricoh Co., Ltd. of which transfer unit was modified. The configuration of the key section is the same as the printer as shown in FIG. 4. A two-component type developing device was used for development. The roller was used for transfer, this roller being the elastic transfer roller 30 that includes an aluminum core metal having a diameter of 20 millimeters and the EPDM layer having a thickness of 1.0 millimeter provided on the aluminum core metal, and that has a hardness of 65 degrees. The transfer pressure was set to about 4 N/cm$^2$. The transfer current was controlled to 1 μA/cm so that dot spread on a transfer paper is 1.1 or less as compared with dots on the photosensitive element 1 without decrease in the transfer efficiency. The developing bias voltage was controlled so that the amount of development is 0.5 mg/cm$^2$.

The fixing process was performed by a roller (hardness on the shaft: 70 degrees). The roller includes an aluminum core metal, and the elastic layer 30*b* that is formed of silicone rubber having a thickness of 300 micrometers (hardness: 25 degrees) and provided thereon, and the silicone rubber being covered with a 20-μm Teflon tube. The surface pressure was controlled to 9.3 N/cm$^2$, and the temperature of the roller was controlled to 190° C.±5° C. The test chart (see FIG. 7) mainly including the gray scale formed with dots of 600 dpi was printed out using the test machine to obtain a sample image.

Evaluation of Transfer Efficiency

A developed chart on the photosensitive element 1 is transferred to transfer paper, and the test machine is stopped when the transfer paper is on a transfer conveyor belt 10. The black solid portion of the chart is checked. The residual toner of the black solid portion on the photosensitive element 1 is peeled by an adhesive tape to obtain a residual toner amount on the photosensitive element 1. On the other hand, the black solid portion of the toner transferred is cut out and the toner is blown off by a compression air. A toner amount transferred is obtained by the weights before and after the toner is blown off, and a transfer ratio (%) is obtained by the following equation (9)

$$(\text{Transfer toner amount}/(\text{transfer toner}+\text{residual toner amount}))\times100(\%) \quad (9)$$

An allowable value of the transfer ratio is 85% or more under ordinary environments. The transfer ratio of 85% or more is determined as "O", which indicates OK. Likewise, the transfer ratio ranging from 80% to 84% is determined as "Δ", which indicates allowable, and 75% or less as "X", which indicates no good (see table 8, and hereinafter the same). The allowable level is "Δ" or higher.

Evaluation of Transfer Dust and Transfer Void

Figure 10A:
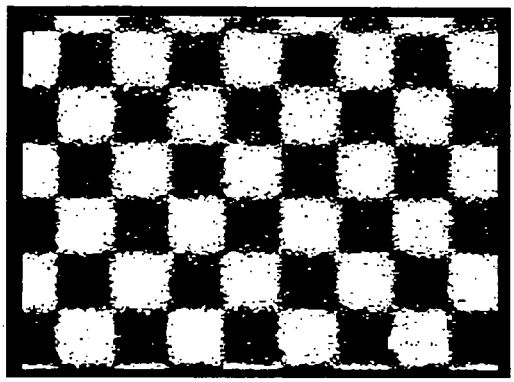
FIG. 10A to FIG. 10C are images of rank samples of transfer dust.
Figure 10B:
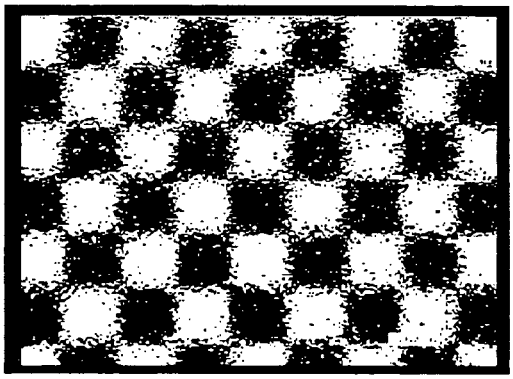
Figure 10C:
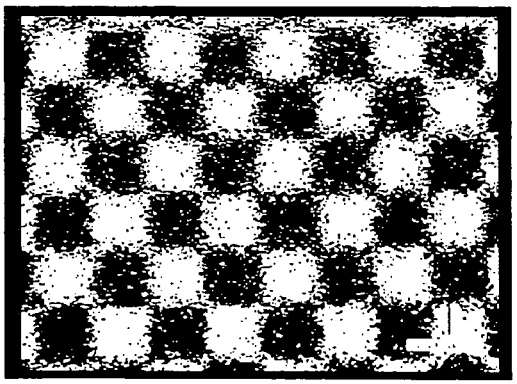

A method of evaluating transfer dust and transfer void is not established. Therefore, a sensory test method was used to visually check samples and rank samples. FIG. 10A to FIG. 10C are images of rank samples of transfer dust. FIG. 11A to FIG. 11C are image of rank samples of transfer voids.

Images of "rank 3" of FIG. 10B and FIG. 11B are indicated by "Δ", which is the allowable level. Images higher than "rank 3", such as images of "rank 5" of FIG. 10A and FIG. 11A, are "OK". Images below the levels of "Δ", such as images of "rank 1" of FIG. 10C and FIG. 11C, are "NG", which is "no good".

Examples including developing conditions and transfer conditions are explained below.

EXAMPLE 2-1

A developer used for development was prepared in the following manner.

The toner No. 8 was used for toner in this example. Toner characteristics were as follows: particle size: 4.0 μm, aggregation: 35%, volume resistivity: $1.8\times10^{9}$ Ω·cm, and average circularity: 0.97.

Figure 12:
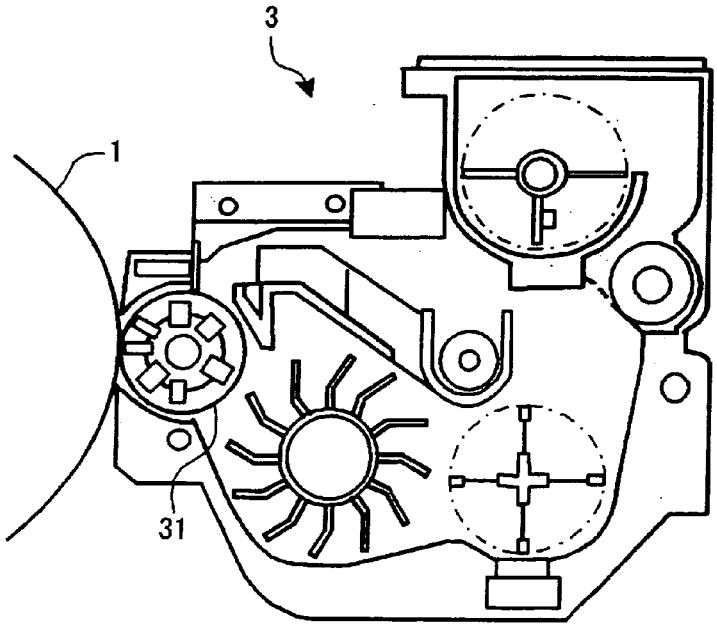
FIG. 12 is a cross section of a developing device for the image forming apparatus used to perform evaluation in examples.

Spherical ferrites having a weight average particle size of 50 micrometers were used for carrier. The surface of the spherical ferrite was coated with silicone resin and thermally dried to obtain the carrier. A developer containing 5.0 wt % of the toner with respect to the carrier was prepared, and put into the developing device of FIG. 12. FIG. 12 is a cross section of the developing device for the image forming apparatus used to evaluate examples.

A digital copying machine Imagio MF7070 manufactured by Ricoh Co., Ltd. with a modified transfer unit was used for transfer. The configuration of the units other than the modified unit is the same as the printer of FIG. 4. An elastic roller was used for the transfer roller. The elastic roller having a hardness of 65 degrees includes an aluminum core metal having a diameter of 20 millimeters and the EPDM layer having a thickness of 1.0 millimeter provided on the aluminum core metal. The transfer pressure was set to about 4 $N/cm^2$. The transfer current was controlled to 1 μA/cm so that dot spread on a transfer paper is 1.1 or less as compared with dots on the photosensitive element 1 without decrease in the transfer efficiency. The dot spread at this time was 1.0.

The modified machine of Imagio MF7070 used as the test machine is explained below. A diameter of a drum of the photosensitive element is 100 millimeters, a linear velocity of the drum is set to 330 mm/sec, and the transfer roller 30 is pushed against the photosensitive element 1 under the conditions so that the transfer roller 30 rotates following rotation of the photosensitive element 1. A diameter of a sleeve of a developing sleeve 31 (FIG. 12) is 25 millimeters and a linear velocity of the sleeve is set to 660 mm/sec. Therefore, a ratio between the linear velocities of the sleeve and the drum is 2.0. A developing gap that is a space between the photosensitive element 1 and the developing sleeve 31 were checked in three levels of 0.3 mm, 0.5 mm, and 0.8 mm.

A doctor gap that is a space between the developing sleeve 31 and a doctor blade is a gap by 95% of the developing gap. The developing sleeve 31 includes a magnet roller, and a magnetic force of a developing polarity is 120 millitesla. The developing bias voltage was controlled so that the amount of development at this time is 0.5±0.05 $mg/cm^2$ under the respective conditions. However, a potential of a latent image on the photosensitive element 1 was fixed to (potential on the background portion −800 volts, image portion −150 volts, 600 dpi binary). Therefore, the developing bias voltage was set as follows: when the developing gap was 0.3 millimeter: −450 volts, 0.5 millimeter: −500 volts, and 0.8 millimeter: −570 volts.

The test chart (see FIG. 7) mainly including the gray scale formed with dots of 600 dpi was printed out using the test machine to obtain a sample image.

The results of checking granularity are given in the following table 7.

TABLE 7

| Developing gap | Granularity | Image density |
|---|---|---|
| 0.30 mm | 0.21 | 1.35 |
| 0.50 mm | 0.25 | 1.36 |
| 0.80 mm | 0.3 | 1.33 |

Figure 13A:
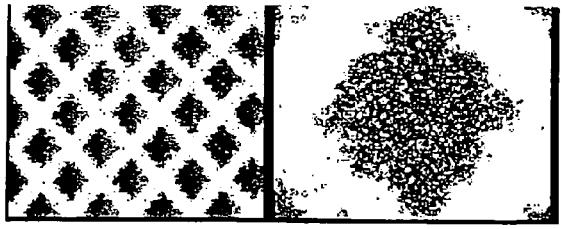
FIG. 13A to FIG. 13C are images obtained by measuring data patterns formed on the photosensitive element using a microscope.
Figure 13B:
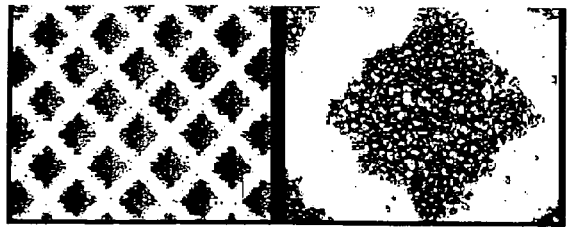
Figure 13C:
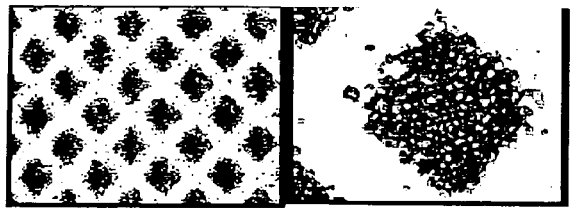
Figure 14A:
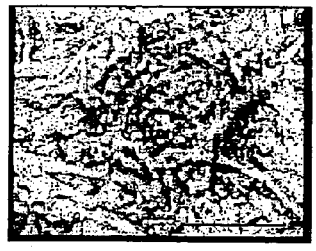
FIG. 14A to FIG. 14C are images for explaining degradation levels of granularity of images after being fixed.
Figure 14B:
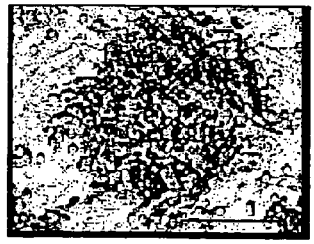
Figure 14C:
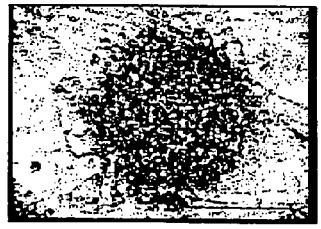

Shapes of dots on the photosensitive element 1 were measured with a 50×-objective lens (a magnification of 1,000 times on a 15-inch cathode-ray tube (CRT)) using an ultra-depth profile measuring microscope VK8500 (hereinafter, "microscope VK8500") manufactured by Keyence Corp. The dots were included in a halftone portion of 41% as a typical data pattern of a toner image obtained on the photosensitive element 1. FIG. 13A to FIG. 13C are images obtained by measuring data patterns formed on the photosensitive element 1 using the microscope, and the images are formed with toner particles having particle sizes of 4.2 micrometers, 6.8 micrometers, and 9.0 micrometers in this order from the top thereof. FIG. 14A to FIG. 14C are images for explaining degradation levels of granularity of images after being fixed, the degradation levels being 0.15, 0.10, and 0.04 in this order from the top thereof.

It is understood from the results of evaluations that the narrow developing gap allows a image latent to be developed comparatively faithfully. In other words, if the developing gap is narrow, the electric field for development is made better caused by charges of the photosensitive element 1, which allows excellent development to be performed. This can be easily determined from the images as shown in FIG. 13A to FIG. 13C. However, there is another important factor which is a supply of toner. If the gap is too narrow, toner becomes short in development of a solid image, which results in an insufficient solid image. Thus, the most adequate developing gap ranges from 0.3 to 0.5 millimeter.

Smaller toner particle size allows development to be more adequate. However, if it is too small, characteristics of individual toner particles are made different from one another because of their dispersing states that depend on toner materials, and a charged amount may be lack of stability. If the toner particle size is 3 micrometers or less, environmental and safety problems come up, and therefore, the most adequate particle size ranges from 4 to 7 micrometers. Polymer toner has a small particle size and is thereby easily controlled. The particle size ranging from 4 to 7 micrometers is an ordinary size for the polymer toner, which means there is no particular problem as far as the size is concerned.

EXAMPLE 2-2

Dot spread was measured by applying the transfer pressure and current using the same method and conditions as these of the example 2-1. The developing gap was fixed to 0.35 millimeter, and the developing bias was −470 volts. The amount of development at this time was 0.6 $mg/cm^2$. The transfer pressure was 4 $N/cm^2$ and the transfer current was 1 μA/cm. The transfer efficiency, the granularity, and the degree of dot spread and the transfer current, each of which was obtained by this example are given in the following tables 8, 9, and 10, respectively.

TABLE 8

| | Transfer efficiency (evaluation in parentheses) | | | |
|---|---|---|---|---|
| Pressure | Current 0.6 μA/cm | 0.8 μA/cm | 1.0 μA/cm | 1.5 μA/cm |
| 0.4 $N/cm^2$ | 30% (X) | 70% (Δ) | 80% (Δ) | 83% (Δ) |
| 1.2 $N/cm^2$ | 35% (X) | 85% (○) | 88% (○) | 90% (○) |
| 2.0 $N/cm^2$ | 50% (X) | 86% (○) | 89% (○) | 92% (○) |
| 5.0 $N/cm^2$ | 65% (X) | 88% (○) | 90% (○) | 90% (○) |
| 8.0 $N/cm^2$ | 70% (Δ) | 83% (Δ) | 85% (○) | 80% (Δ) |

TABLE 9

| | Granularity | | | |
|---|---|---|---|---|
| Pressure | Current 0.6 μA/cm | 0.8 μA/cm | 1.0 μA/cm | 1.5 μA/cm |
| 0.4 $N/cm^2$ | Out of measurement | 0.51 | 0.4 | 0.5 |

TABLE 9-continued

| Pressure | Granularity | | | |
|---|---|---|---|---|
| | Current 0.6 μA/cm | 0.8 μA/cm | 1.0 μA/cm | 1.5 μA/cm |
| 1.2 N/cm$^2$ | 0.4 | 0.25 | 0.25 | 0.3 |
| 2.0 N/cm$^2$ | 0.35 | 0.21 | 0.24 | 0.24 |
| 5.0 N/cm$^2$ | 0.3 | 0.19 | 0.2 | 0.25 |
| 8.0 N/cm$^2$ | 0.28 | 0.25 | 0.35 | 0.4 |

TABLE 10

| Pressure | Degree of dot spread and transfer current upon transfer | | | |
|---|---|---|---|---|
| | Dot ratio 1.2 | Dot ratio 1 | Dot ratio 0.8 | Dot ratio 0.6 |
| 0.4 N/cm$^2$ | 1.5 μA/cm | Out of measurement | Out of measurement | Out of measurement |
| 1.2 N/cm$^2$ | 1.5 μA/cm | 1.1 μA/cm | 1.2 μA/cm | 1.0 μA/cm |
| 2.0 N/cm$^2$ | 1.4 μA/cm | 1.1 μA/cm | 1.0 μA/cm | 0.8 μA/cm |
| 5.0 N/cm$^2$ | 1.5 μA/cm | 1.0 μA/cm | 0.8 μA/cm | 0.5 μA/cm |
| 8.0 N/cm$^2$ | 0.6 μA/cm | 0.4 μA/cm | Out of measurement | Out of measurement |

From the tables 8 and 9, it is understood that satisfactory values as the transfer ratio were not obtained at a current of less than 0.6 μA/cm because of a shortage thereof. If the pressure is low and the current is small, the transfer ratio lowers. At 1.5 μA/cm, discharge occurs during the transfer, and the transfer ratio decreases under the condition of high pressure. The granularity is degraded at the transfer pressure of 0.4 N/cm$^2$. This is because a nip width between the transfer roller 30 and the photosensitive element 1 is narrower than that of the conventional technology. When the transfer pressure is increased to 8.0 N/cm$^2$, the granularity decreases as well. This is because, as is also understood from the table 10, the dot spread due to the leak may also exert influence over the transfer current. Moreover, when the transfer pressure is 6 N/cm$^2$ or more, the mechanical strength also becomes significant. Consequently, the degradation in the granularity increases. Although there is not much difference found between the transfer currents when only the transfer efficiency is measured as is in the conventional manner, a significant difference is recognized between the transfer currents as is claimed in the present invention when evaluation is conducted based on the granularity.

As is apparent from FIGS. 10A to 10C and the tables 9 and 10, at the transfer current of 2.0 μA/cm or more, changes in shape and dust increase caused by discharge. Furthermore, referring to the degree of dot spread, a transfer current is approximately 1.0 μA/cm even if the transfer pressure is changed. From this, it is understood that constant current control is an ideal control method if the transfer pressure changes in a range from about 1.0 N/cm$^2$ to about 5.0 N/cm$^2$. Therefore, the constant current control is the most adequate for the transfer current control according to the present invention.

Consequently, it is found that the most adequate condition is a combination such that when the transfer pressure is set to a predetermined condition of 1.0 N/cm$^2$ to 5.0 N/cm$^2$, a constant current control is about 1.0 μA/cm±20% for the transfer current. The best granularity is 0.19.

As for the characteristics of the transfer roller 30, characteristics of the elastic layer are as follows: hardness: 60 to 80 degrees, and thickness: 0.5 to 3.0 millimeters, preferably, 0.5 to 1.0 millimeter. If the elastic layer is low in hardness and thin in thickness, the force to push the transfer paper becomes lower, and the nip becomes larger, which causes the transfer blur of toner to occur. If the hardness of the elastic layer is too high, even if the pressure is applied to the transfer paper, the elastic layer cannot fit along fiber irregularities of the transfer paper and contact points do not increase, which causes less effective in practical reduction of air gaps.

EXAMPLE 2-3

Toner particle size and granularity were measured using the same method and conditions as these of the example 2-1. The developing gap was fixed to 0.35 millimeter, and the developing bias was controlled so that the amount of development at this time was 0.5±0.05 mg/cm$^2$. The transfer pressure was 4 N/cm$^2$ and the transfer current was 1 μA/cm.

The toner No. 1 was used for toner in this example. Toner characteristics were as follows: particle size: 7.0 μm, aggregation: 45%, volume resistivity: 8.5×10$^9$ Ω·cm, and average circularity: 0.95.

In order to obtain particle sizes of about 4 micrometers and 8 micrometers, the mixture of the toner No. 1 was kneaded at 130° C. using the biaxial extruder. At the time of pulverizing the mixture by the mechanical pulverizer and classifying it, pulverizing conditions were changed and the mixture was pulverized and classified to obtain toner particles having average particle sizes of 4.2 micrometers, 7.0 micrometers, and 8.5 micrometers. These three types of toner particles were respectively mixed with 0.2 wt % of silica (R-972: Nippon Aerosil Co., Ltd.) by the Henschel mixer to obtain the respective toner. The same carrier as that of the example 2-1 was used for carrier in this example to obtain developer.

Image density and granularity were checked using the developer. At the same time, an average height in a z-axial direction of a toner image obtained on the photosensitive element and a surface roughness of an area of 0.1×0.1 millimeter were measured and noted. The data for the z-axis of the toner on the photosensitive element was obtained by using an average value of cross-sectional heights and surface roughness measured with the 50×-objective lens (a magnification of 1,000 times on the 15-inch CRT) using the microscope VK8500 manufactured by Keyence Corp. The results of measurement are given in the following table 11. A relation between a toner height and dot spread is given in table 12, and a relation between a toner height and an amount of development is given in table 13.

TABLE 11

| Toner particle size | Toner height | Surface roughness | Image density | Granularity |
|---|---|---|---|---|
| 8.5 μm | 26 μm | 25.4 μm | 1.46 | 0.3 |
| 8.5 μm | 17 μm | 24.0 μm | 1.43 | 0.24 |
| 6.8 μm | 21 μm | 16.0 μm | 1.38 | 0.24 |
| 4.2 μm | 13 μm | 11.5 μm | 1.42 | 0.22 |
| 4.2 μm | 21 μm | 12.0 μm | 1.46 | 0.24 |

TABLE 12

| Average toner particle size | Dot spread (toner width after transfer:L/toner width after development: d) Toner height: About one layer | About two layers | About three layers | About four layers | About five layers |
|---|---|---|---|---|---|
| 4 μm toner | 0.5 | 0.9 | 1 | 1.05 | 1.1 |
| 6 μm toner | 0.6 | 0.9 | 1.05 | 1.1 | 1.2 |
| 8 μm toner | 0.7 | 1 | 1.1 | 1.15 | 1.3 |
| 10 μm toner | 0.7 | 1 | 1.15 | 1.25 | 1.4 |

TABLE 13

| Average toner particle size | Amount of development Toner height: About one Layer | About two layers | About three layers | About four layers | About five layers |
|---|---|---|---|---|---|
| 4 μm toner | 0.3 | 0.45 | 0.5 | 0.55 | 0.65 |
| 6 μm toner | 0.4 | 0.9 | 0.55 | 0.6 | 0.7 |
| 8 μm toner | 0.45 | 1 | 0.65 | 0.7 | 0.9 |
| 10 μm toner | 0.5 | 0.65 | 0.8 | 0.9 | 1.1 |

As shown in the tables 12 and 13, the term of "about one layer" related to the height of toner corresponds to a height of toner such that toner particles having an average particle size are aligned in one layer. Therefore, one layer of 4-μm toner corresponds to about 4 micrometers in toner height, and three layers of 6-μm toner correspond to about 18 micrometers in toner height.

Figure 15:
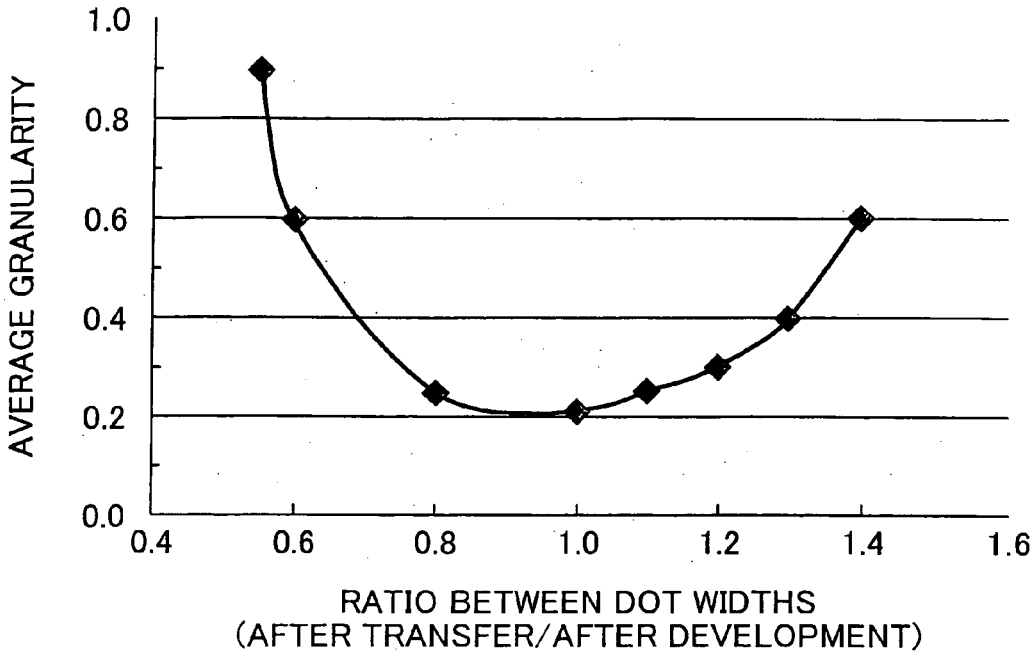
FIG. 15 is a graph of changes of granularity with respect to a ratio between a dot width after a toner image is transferred and a dot width after an image is developed.

It is understood from the results of evaluation that there is a difference in granularities depending on the average toner particle sizes and the heights of toner, and that the difference is almost the same as a difference in the dot spreads. FIG. 15 is a graph of changes of granularity with respect to a ratio between a dot width after the transfer and a dot width after the development. The granularity is degraded (numeric values increase) when the dot spread is wide or narrow. The wide dot spread means that toner dust upon transfer increases, which makes the dot spread wider than that of an image that should be developed. Therefore, degradation in granularity is easily understood from the fact as explained above. The degree of spread is desired as 1.2, and preferably, 1.1 or less. On the other hand, the narrow dot spread means that toner is not satisfactorily transferred, which leads to the uneven toner image. Moreover, the image density decreases, and therefore, 0.7, preferably, 0.8 or more is desired as the degree of spread.

A smaller average toner particle size is better. This is because the small toner particle size allows a toner layer after the development to be uniform, which leads to excellent development of a latent image. This fact is easily understood from the sample images as shown in FIG. 13A to FIG. 13C.

Therefore, a ratio (L/d) between the dot area on the transfer element and the dot area on the photosensitive element is preferably 0.8 to 1.1. Furthermore, the height of the toner on the transfer element and that of the toner on the photosensitive element are four times, preferably, three times or less the average toner particle size, respectively.

The developing gap is set to 0.35 millimeter, but in order to faithfully develop a latent image, a developing electric field due to charges on the photosensitive element should be larger, which allows development to be performed more satisfactorily. However, there is another important factor which is a supply of toner. If the gap is too narrow, toner becomes short in development of a solid image, which causes an insufficient solid image to be obtained. Thus, the most adequate developing gap ranges from 0.3 to 0.5 millimeter.

Smaller toner particle size allows development to be more adequate. However, if it is too small, characteristics of individual toner particles are made different from one another because of their dispersing states that depend on toner materials, and a charged amount may be lack of stability. If the toner particle size is 3 micrometers or less, environmental and safety problems come up, and therefore, the most adequate particle size ranges from 4 to 7 micrometers.

EXAMPLE 2-4

Toner characteristic that largely contributes to development is circularity.

Pulverized toner particles having different circularities are subjected to thermal treatment and round treatment by using a Hybridization system (manufactured by Nara Machinery Co. Ltd.). The treatments are performed at a temperature of 50° C. to 60° C. and at 2,000 rpm to 8,000 rpm.

An average-circularity can be measured by the Flow particle image analyzer FPIA-2100 manufactured by Sysmex Corp. The measurement was conducted in the following manner. Primary sodium chloride was used to prepare 1% NaCl aqueous solution, and it was made to pass through a filter of 0.45 micrometer to obtain a liquid of 50 to 100 milliliters. The liquid was added with a surface active agent as a dispersant, preferably, 0.1 to 5 milliliters of alkyl benzene sulfonate, and further added with 1 to 10 milligrams of sample. The resultant liquid was subjected to dispersion for one minute by an ultrasonic disperser to obtain a dispersant with a particle density controlled to 5,000to 15,000/μl, and the dispersant was used for the measurement.

A diameter of a circle having area the same as area of a two-dimensional image that was obtained by capturing a toner particle by a CCD camera was determined as the circle-corresponding diameter. A particle size of 0.6 micrometer or more based on the circle-corresponding diameter was determined as an effective value from the pixel accuracy of the CCD and used to calculate an average circularity. The average circularity is obtained by calculating circularities of particles to add the circularities to one another, and dividing the result of addition by the total number of particles. The circularity of each particle is calculated by dividing a perimeter of the circle having projected area the same as the area of a toner particle image by a perimeter of the projected toner particle image.

The toner No. 1 (average particle size: 7 μm) was used for toner in this example to obtain five types of circularities.

The circularities obtained by the treatments and estimated average granularity on the photosensitive element as a result of testing are given in the following table 14.

TABLE 14

| Hybridization system: rpm (at 50 to 60° C.) | Circularity | Granularity |
|---|---|---|
| 8000 rpm | 0.99 | 0.12 |
| 6000 | 0.96 | 0.12 |
| 4000 | 0.94 | 0.13 |
| 2000 | 0.9 | 0.14 |
| Not treated | 0.88 | 0.2 |

It is understood from the results of evaluation that an average circularity of 0.90 or more allows excellent development to be performed. The upper limit of the circularity is 1.0 as a perfect spherical shape, and therefore, 0.9 or more should be defined.

If the average circularity is less than 0.90, the toner particle becomes unstable, which causes an aggregation state of the toner image on the photosensitive element is nonuniform. Therefore, the development lacks fidelity to the latent image and uniformity of the toner image in the z-axial direction, which causes the estimated average granularity on the photosensitive element to be degraded. Toner particles in the height direction (z-axial direction) are uneven, which causes bad influence to be exerted over the transfer characteristics.

EXAMPLE 2-5

The toner No. 1 to the toner No. 8 were used to prepare toner in this example in the same method as that-of the example 2-1. Spherical ferrites having a weight average particle size of 50 micrometers were used for carrier in this example, and the surface of the spherical ferrite was coated with silicone resin and thermally dried to obtain the carrier. The density of a developer was obtained by mixing 5.0 wt % of the toner with respect to the carrier.

Figure 7:
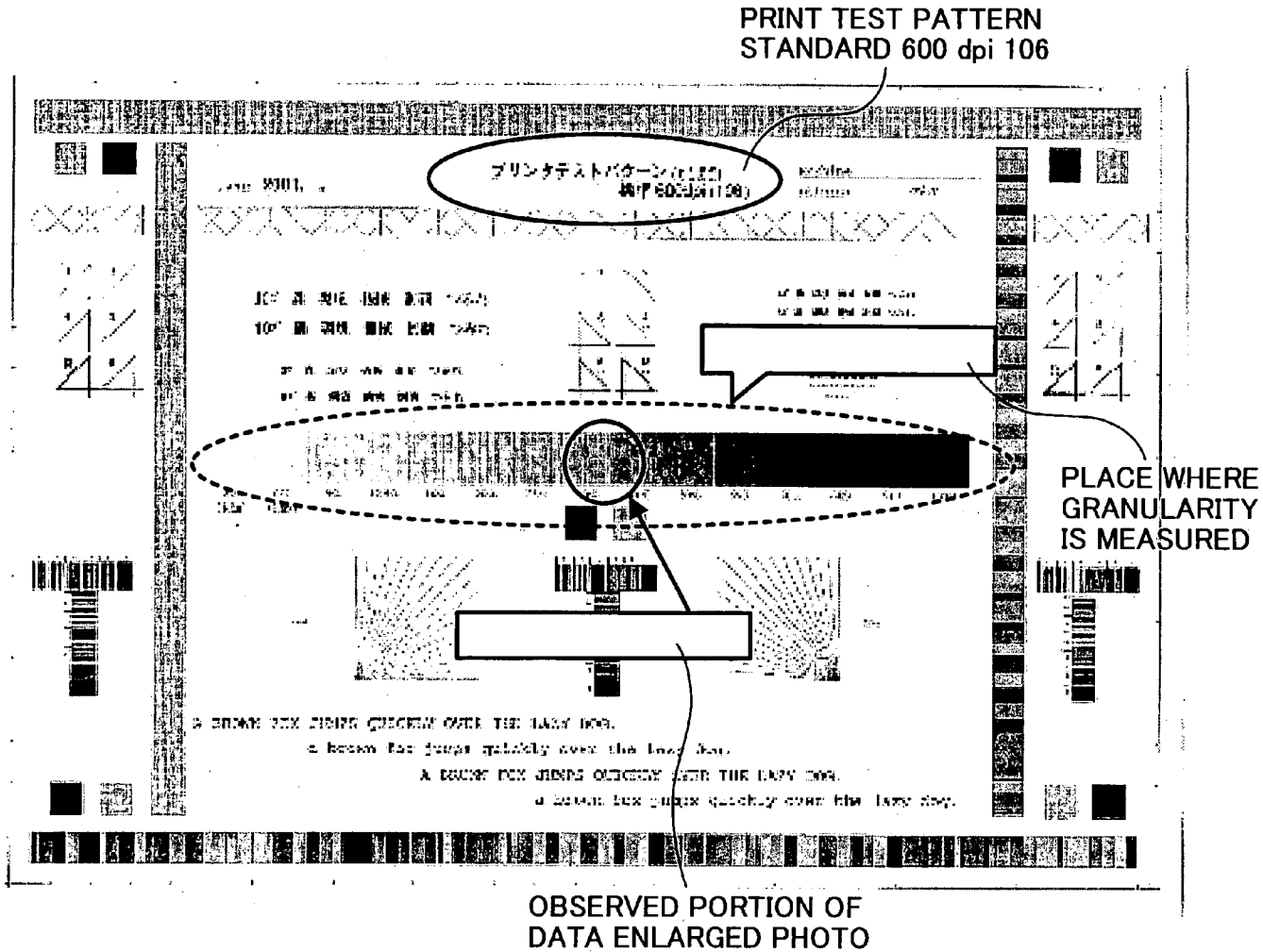
FIG. 7 is a diagram of a test pattern used to measure the granularity.

The pushing force for transfer was set to 4 N/cm$^2$ and the transfer current was set to 1.0 μA/cm to output the test chart of FIG. 7. The transfer paper used was Type 6000 (manufactured by Ricoh Co., Ltd.), and evaluation on transfer efficiency and transfer dust was conducted. The results of evaluation are given in the following table 15.

TABLE 15

| Toner No | Rank of transfer ratio | Rank of transfer dust |
|---|---|---|
| 1 | ○ | ○ |
| 2 | Δ | X |
| 3 | Δ | Δ |
| 4 | X | X |
| 5 | X | X |
| 6 | Δ | ○ |
| 7 | X | Δ |
| 8 | ○ | ○ |

It is understood from the table 6 and the table 1 5 that the aggregation of toner affects the transfer efficiency. Low volume resistivity of toner affects the transfer ratio, but does not largely affect the transfer dust. Moreover, if the toner hardness is higher, it is more advantageous against the transfer dust, but the pushing force needs to be changed to improve the transfer dust because of the toner aggregation. As for the toner No. 3, for example, by changing the transfer current from 1.0 μA/cm to 0.8 μA/cm, the rank "Δ" of the transfer dust was improved to "O".

Based on the table 6 and the table 15, the adequate aggregation of toner is from 20% to 50%, and the volume resistivity of toner is preferably $1\times10^9$ Ω·cm or higher.

The present invention has been explained with reference to the configurations and the examples, but it is not limited thereby. The image forming apparatus is not limited by the printer, and a copying machine or a facsimile may be used. The configuration of the transfer unit or the developing device may be any configuration if it satisfies the existing conditions defined in the present invention.

An image forming apparatus according to a third embodiment of the present invention is the same as that of FIG. 4. The transfer unit of the image forming apparatus is the same as that of FIG. 5.

As explained above, the granularity is related to an image after being fixed, and therefore, fixing conditions to be used here are described below. The granularity hereinafter is obtained by using a fixing unit explained below.

The fixing unit is the same as that used in the second embodiment. Details of the contents are performed in the same manner as these of the second embodiment.

However, there is one of different points from that of the second embodiment as explained below. The transfer roller 30 as the transfer .device is pushed at a predetermined transfer pressure of 1.0 N/cm$^2$ to 3.0 N/cm$^2$ so that a ratio between the dot area on the transfer element and the dot area on the photosensitive element is 1.1 or less, and a transfer current during passage of transfer paper is controlled at this pushing pressure.

Another difference is explained here. The toner used in this example has a particle-size distribution of toner in the developer of 1.3 or less, and has an average circularity of 0.95 or higher. The developing gap of the developing device used in this case is set to 0.3 to 0.5 millimeter to perform development. Then, another developing means such as developing bias and developer carrier or the like are selectively controlled so that an amount of development on the photosensitive element after the image passes through the developing process is set to 0.4 mg/cm$^2$ to 0.9 mg/cm$^2$.

There is one of similar points to that of the second embodiment as explained below. A current applied to the transfer roller is set to a value near an inflection point of the current based on a relation between a roller bias and a transfer current typified with reference to FIG. 9. It is thereby controlled so as to apply the current that is not more than a current which leaks from a transfer element held by the roller and the photosensitive element, and that is not less than a current at which electrostatic transfer is possible.

Another similar point is that insulating toner as follows is used. The insulating toner has an aggregation of 20% to 50% and a volume resistivity of $1\times10^9$ Ω·cm or higher.

Moreover, the method of measuring aggregation and the method of manufacturing toner are the same as these in the second embodiment. The toner particle size is measured by using, for example, Coulter Multisizer IIe. A diameter of an aperture upon the measurement is 100 micrometers. Although a dispersion of the toner particle sizes is dependent on the results of measurement, the number of revolutions and the amounts of air in a classifying process were changed in the following toner formulas so that the toner dispersion is 1.3 or less as claimed in the present invention.

Toner formulas 1 to 8 are the same as the toner No. 1 to the toner No. 8 in the second embodiment.

TABLE 16

| | List of toner characteristics | | | | |
|---|---|---|---|---|---|
| | Hardness | Aggregation | Volume resistivity | Particle size | Dispersion |
| Toner formula 1 | 8 Degrees | 45% | 8.5 × 10E9 Ωcm | 7.0 μm | 1.30 |
| Toner formula 2 | 6 Degrees | 8% | 5.5 × 10E8 Ωcm | 5.5 μm | 1.25 |
| Toner formula 3 | 11 Degrees | 55% | 8.8 × 10E9 Ωcm | 5.0 μm | 1.28 |
| Toner formula 4 | 14 Degrees | 20% | 4.2 × 10E7 Ωcm | 9.5 μm | 1.23 |
| Toner formula 5 | 10 Degrees | 15% | 9.5 × 10E8 Ωcm | 8.5 μm | 1.25 |
| Toner formula 6 | 11 Degrees | 41% | 9.8 × 10E8 Ωcm | 5.0 μm | 1.30 |
| Toner formula 7 | 10 Degrees | 25% | 3.5 × 10E7 Ωcm | 8.5 μm | 1.32 |
| Toner formula 8 | 10 Degrees | 35% | 1.8 × 10E9 Ωcm | 4.0 μm | 1.30 |

The table 16 is the same as the table 6 except for the toner dispersion that is added to the table 16.

The method of evaluation according to the present invention is explained below.

Method of Evaluating Transfer Efficiency and Transfer Dust

A test machine is the same as that used in the second embodiment except for a point such that an elastic roller having a hardness of 55 degrees is used, a transfer pressure is set to about 3 N/cm$^2$, and a developing bias voltage is controlled so that an amount of development is 0.6 mg/cm$^2$.

"Evaluation of transfer efficiency" and "Evaluation of transfer dust and transfer void" are performed in the same manner as those of the second embodiment.

EXAMPLE 3-1

A developer used for development was prepared in the following manner. The toner formula 8 was used for a toner formula in this example. The toner characteristics were as follows: particle size: 4.0 μm, dispersion: 1.30, aggregation: 35%, volume resistivity: $1.8\times10^9$ Ω·cm, and average circularity: 0.97. Spherical ferrites having a weight average particle size of 50 micrometers were used for carrier, and the surface of the spherical ferrite was coated with silicone resin and thermally dried to obtain the carrier. A developer containing 5.0 wt % of the toner with respect to the carrier was prepared, and put into the developing device of FIG. 12.

Imagio MF7070 manufactured by Ricoh Co., Ltd. with a modified transfer unit was used for transfer. The configuration of the units is the same as the schematic diagram of the image forming apparatus as shown in FIG. 4. An elastic roller was used for the transfer roller 30. The elastic roller has a hardness of 55 degrees, and includes an aluminum core metal having a diameter of 20 millimeters and the EPDM layer having a thickness of 1.0 millimeter provided on the aluminum core metal. The transfer pressure was set to about 3 N/cm$^2$. The transfer current was controlled to 1 μA/cm so that dot spread on the transfer element was 1.1 or less as compared with dots on the photosensitive element without decrease in the transfer efficiency. The dot spread in this example was 1.0.

Imagio MF7070 manufactured by Ricoh Co., Ltd. with a modified transfer unit was used as the test machine. A diameter of a drum of the photosensitive element is 100 millimeters, a linear velocity of the drum is set to 330 mm/sec, and the transfer roller is pushed against the photosensitive element under the conditions so that the transfer roller rotates following rotation of the photosensitive element. A diameter of a sleeve of a developing sleeve is 25 millimeters and a linear velocity of the sleeve is set to 660 mm/sec. Therefore, a ratio between the linear velocities of the drum and the sleeve is 2.0.

The developing gap was checked in three levels of 0.3 mm, 0.5 mm, and 0.8 mm. The doctor gap has a gap of 95% of the developing gap. A magnetic force of a polarity is 120 millitesla. The developing bias voltage was controlled so that the amount of development at this time is 0.6±0.05 mg/cm$^2$ under the respective conditions. However, a potential of a latent image on the photosensitive element was fixed to (potential on the background portion: −800 volts, image portion: −150 volts, 600 dpi binary). Therefore, the developing bias voltage was set as follows: when the developing gap was 0.3 millimeter: −450 volts, 0.5 millimeter: −500 volts, and 0.8 millimeter: −570 volts.

The test chart (see FIG. 7) mainly including the gray scale formed with dots of 600 dpi was printed out using the test machine to obtain a sample image.

Figure 16A:
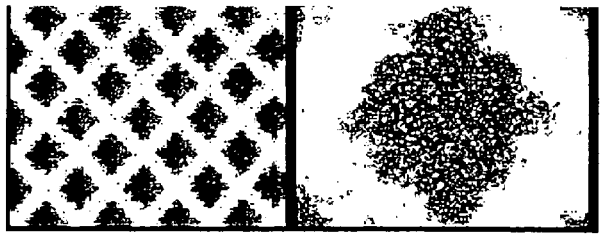
FIG. 16A to FIG. 16C are images obtained by measuring data patterns formed on the photosensitive element using a microscope according to a third embodiment of the present invention.
Figure 16B:
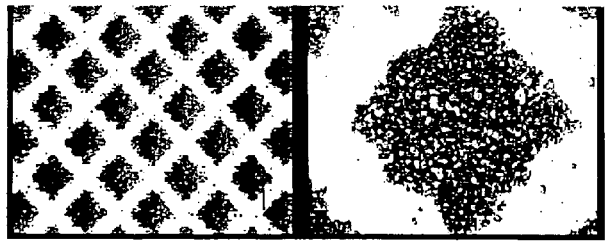
Figure 16C:
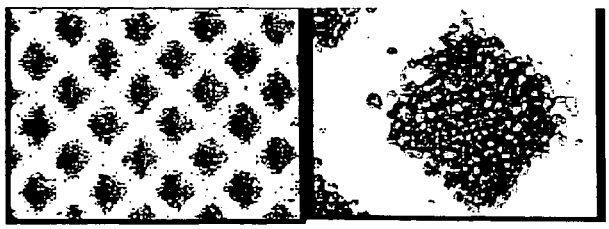
Figure 17A:
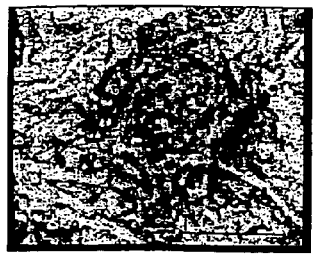
FIG. 17A to FIG. 17C are images for explaining degradation levels of granularity of images after being fixed.
Figure 17B:
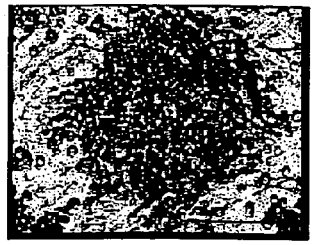
Figure 17C:
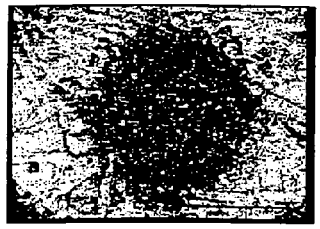

The results of checking granularity are given in table 17. Shapes of dots on the photosensitive element were measured with the 50×-objective lens (a magnification of 1,000 times on the 15-inch CRT) using the microscope VK8500 manufactured by Keyence Corp. The dots were included in a halftone portion of 41% as a typical data pattern of a toner image obtained on the photosensitive element. Images measured are shown in FIG. 16A to FIG. 16C. FIG. 16A to FIG. 16C are images obtained by measuring data patterns formed on the photosensitive element 1 using the microscope, and the images are formed with toner particles having particle sizes of 4.2 micrometers, 6.8 micrometers, and 9.0 micrometers in this order from the top thereof. FIG. 17A to FIG. 17C are images for explaining degradation levels of granularity of images after being fixed, the degradation levels being 0.15, 0.10, and 0.04 in this order from the top thereof.

TABLE 17

| Developing gap and granularity (developing performance) | | |
|---|---|---|
| Developing gap | Granularity | Image density |
| 0.30 mm | 0.21 | 1.35 |
| 0.50 mm | 0.25 | 1.36 |
| 0.80 mm | 0.30 | 1.33 |

It is found from the results that the narrow developing gap allows a latent image to be comparatively faithfully developed. In other words, if the developing gap is narrow, the electric field for development is made better caused by charges of the photosensitive element, which leads to excellent development. This can be easily determined from the samples as shown in FIG. 16A to FIG. 16C.

However, there is another important factor which is a supply of toner. If the gap is too narrow, toner becomes short in development of a solid image, which results in an insufficient solid image. Thus, the most adequate developing gap ranges from 0.3 to 0.5 millimeter. Smaller toner particle size allows development to be more adequate. Polymer toner has a small particle size and is thereby easily controlled. Its ordinary particle size is about 4 micrometers, which means there is no particular problem as far as the size is concerned. However, toner particles being too small are not preferable because excessive toner particles are hard to be removed from the photosensitive element during a cleaning process in the image forming apparatus, which is disadvantageous. Characteristics of individual toner particles of pulverized toner are made different depending on toner materials, and a charged amount may be lack of stability. If the toner particle size is 3 micrometers or less, environmental and safety problems come up, and therefore, the most adequate particle size ranges from 4 to 9 micrometers.

EXAMPLE 3-2

Dot spread was measured by applying the transfer pressure and current using the same method and conditions as these of the example 3-1. The developing gap was fixed to 0.35 millimeter, and the developing bias was −470 volts. The amount of development in this case was 0.6 mg/cm$^2$. The transfer pressure was 3 N/cm$^2$ and the transfer current was 1 μA/cm. The results of the transfer efficiency, the granularity, and the degree of dot spread and transfer current are given in the following tables 18, 19, 20, respectively.

TABLE 18

| Transfer efficiency | | | | |
|---|---|---|---|---|
| Pressure/Current | 0.6 μA/cm | 0.8 μA/cm | 1.0 μA/cm | 1.5 μA/cm |
| 0.4 N/cm$^2$ | 30% (X) | 70% (Δ) | 80% (Δ) | 83% (Δ) |
| 1.2 N/cm$^2$ | 35% (X) | 85% (○) | 88% (○) | 90% (○) |
| 2.0 N/cm$^2$ | 50% (X) | 86% (○) | 89% (○) | 92% (○) |
| 3.0 N/cm$^2$ | 65% (X) | 88% (○) | 90% (○) | 90% (○) |
| 5.0 N/cm$^2$ | 70% (Δ) | 90% (Δ) | 90% (○) | 80% (Δ) |

TABLE 19

| Granularity | | | | |
|---|---|---|---|---|
| Pressure/Current | 0.6 μA/cm | 0.8 μA/cm | 1.0 μA/cm | 1.5 μA/cm |
| 0.4 N/cm$^2$ | Out of measurement | 0.51 | 0.40 | 0.50 |
| 1.2 N/cm$^2$ | 0.40 | 0.25 | 0.25 | 0.30 |
| 2.0 N/cm$^2$ | 0.35 | 0.21 | 0.24 | 0.24 |
| 3.0 N/cm$^2$ | 0.30 | 0.19 | 0.20 | 0.25 |
| 5.0 N/cm$^2$ | 0.28 | 0.25 | 0.35 | 0.40 |

TABLE 20

| Degree of dot spread and transfer current upon transfer | | | | |
|---|---|---|---|---|
| Pressure/dot | 1.2 | 1.0 | 0.8 | 0.6 |
| 0.4 N/cm$^2$ | 1.5 μA/cm | Out of measurement | Out of measurement | Out of measurement |
| 1.2 N/cm$^2$ | 1.5 μA/cm | 1.1 μA/cm | 1.2 μA/cm | 1.0 μA/cm |
| 2.0 N/cm$^2$ | 1.4 μA/cm | 1.1 μA/cm | 1.0 μA/cm | 0.8 μA/cm |
| 3.0 N/cm$^2$ | 1.5 μA/cm | 1.0 μA/cm | 0.8 μA/cm | 0.5 μA/cm |
| 5.0 N/cm$^2$ | 0.6 μA/cm | 0.4 μA/cm | Out of measurement | Out of measurement |

From the tables 18 and 19, it is understood that satisfactory values as the transfer ratio were not obtained at a current of less than 0.6 μA/cm because of a shortage thereof. This is because a low pressure and a small current cause the transfer ratio to lower. At 1.5 μA/cm, discharge occurs during the transfer, while the transfer ratio decreases under the condition of high pressure. The granularity is degraded at the transfer pressure of 0.4 N/cm$^2$. This is because a nip width between the transfer roller 30 and the photosensitive element 1 is narrower than that of the conventional technology. When the transfer pressure is increased to 5.0 N/cm$^2$, the granularity decreases as well. This is because, as is also understood from the table 20, the dot spread due to the leak may also exert influence over the transfer current. Moreover, when the transfer pressure is 6 N/cm$^2$ or higher, the mechanical strength also becomes significant. As a result, the degradation in the granularity increases. Although there is not much difference found between transfer currents when only the transfer efficiency is measured as is in the conventional manner, a significant difference is recognized as is claimed in the present invention when evaluation is conducted based on the granularity.

As is apparent from FIGS. 10A to 10C and the tables 18 and 19, when the transfer current is 2.0 μA/cm or more, changes in shape and dust increase caused by discharge. Furthermore, related to the degree of dot spread, a transfer current is approximately 1.0 μA/cm even if the transfer pressure is changed. As a result, it is understood that the constant current control is an ideal control method if the transfer pressure changes in a range from about 1.0 N/cm$^2$ to about 3.0 N/cm$^2$. Therefore, the control of the transfer current as claimed in the present invention can be achieved by means of the constant current control.

Consequently, it is found that the most adequate condition is a combination such that when the transfer pressure is set to a predetermined condition of 1.0 N/cm$^2$ to 3.0 N/cm$^2$, a constant current control is about 1.0 μA/cm±20% for the transfer current. The best granularity is 0.19.

The measurements were conducted by the apparatus including the roller of which hardness used in the example 3-2 was changed to 70 degrees and 30 degrees. When the hardness was 70 degrees, the measured values of the transfer efficiency and the granularity were the same as the results at any transfer pressure and current condition, for example, the transfer pressure of 2.0 N/cm$^2$ or higher. However, a basic image was degraded in such a manner that an image was nonuniform such that the image density at an edge of the image was higher than that of the central portion thereof, which is called "edge transfer", or that surface stain was noticeable in an image. By decreasing the transfer pressure, the edge transfer was reduced. On the other hand, it was difficult to reduce the image density and to control the transfer current, and values cannot thereby uniformly be set because of environments and types of transfer paper. Thus, controls of transfer currents corresponding to individual cases were required.

When the hardness was further increased, the transfer roller could not fit along fiber irregularities of transfer paper even if the pressure applied to the transfer paper. As a result, contact points did not increase, which became ineffective in practical reduction of air gaps. Because of this, improved granularity as the gist of the present invention was not obtained.

A roller having a reduced hardness, for example, 30 degrees was incorporated in the image forming apparatus. The image quality including basic image items in this case is the same as that obtained by using the roller having a hardness of 60 degrees. However, if the thickness of the roller is less than 3 millimeters, the transfer void easily occurs because of a curvature of the core metal. By making the thickness further thicker, the defects may be improved. However, a voltage to obtain a transfer current increases, which causes leak to easily occur depending on environments, types of transfer paper, and aging degradation, and causes control of a transfer current to be difficult, which is inadequate. Furthermore, by making the hardness softer, the force to push the transfer paper reduced in a thin elastic layer and the nip increased, which causes transfer blur of toner to occur.

Preferable characteristics of the elastic layer of the transfer roller are as follows. The hardness is required to be higher to an extent such that the edge transfer does not occur, and is 60 degrees or less, preferably, from 30 to 60 degrees. The thickness is 0.5 to 3.0 millimeters, preferably, from 0.5 to 2.0 millimeters.

EXAMPLE 3-3

Toner particle size and granularity were measured using the same method and conditions as these of the example 3-1. The developing gap was fixed to 0.35 millimeter, and the developing bias was controlled so that the amount of development in this case was 0.7±0.05 mg/cm$^2$. The transfer pressure was 3 N/cm$^2$ and the transfer current was 1 μA/cm.

The toner formula 1 was used for toner in this example. Toner characteristics were as follows: particle size: 7.0 μm, dispersion: 1.30, aggregation: 45%, volume resistivity: 8.5×10$^9$ Ω·cm, and average circularity: 0.95.

In order to obtain particle sizes of about 4 micrometers and 8 micrometers, after the mixture of the toner formula 1 was kneaded at 130° C. using the biaxial extruder. When the mixture was to be pulverized by the mechanical pulverizer and to be classified, pulverizing conditions were changed and the mixture was pulverized and classified to obtain toner particles having average particle sizes of 4.2 μm/dispersion 1.30, 7.0 μm/dispersion 1.28, and 8.5 μm/dispersion 1.30. These three types of toner particles were respectively mixed with 0.2 wt % of silica (R-972: Nippon Aerosil Co., Ltd.) by the Henschel mixer to obtain the toner. The same carrier as that of the example 3-1 was used for carrier in this example to obtain developer.

Image density and granularity were checked using the developer. At the same time, an average height in a z-axial direction of a toner image obtained on the photosensitive element and a surface roughness of an area of 0.1×0.1 millimeter were measured and noted. The data for the z-axis of the toner on the photosensitive element was obtained by using an average value of cross-sectional heights and surface roughness measured with the 50×-objective lens (a magnification of 1,000 times on the 15-inch CRT) using the microscope VK8500 manufactured by Keyence Corp. The results of measurement are given in the following table 21. Furthermore, a relation between a toner height and dot spread is given in table 22, and a relation between a toner height and an amount of development is given in table 23.

TABLE 21

Z-axis data on photosensitive element and transfer dust

| Particle size | Toner height | Surface roughness | Image density | Granularity |
|---|---|---|---|---|
| 8.5 μm | 26 μm | 25.4 μm | 1.46 | 0.30 |
| 8.5 μm | 17 μm | 24.0 μm | 1.43 | 0.24 |
| 6.8 μm | 21 μm | 16.0 μm | 1.38 | 0.24 |
| 4.2 μm | 13 μm | 11.5 μm | 1.42 | 0.22 |
| 4.2 μm | 21 μm | 12.0 μm | 1.46 | 0.24 |

TABLE 22

Toner height and dot spread
(toner width after transfer: L/toner width after development: d)

| | Toner height | | | | |
|---|---|---|---|---|---|
| Average toner particle size | About one layers | About two layers | About three layers | About four layers | About five layers |
| 4 μm toner | 0.5 | 0.90 | 1.0 | 1.05 | 1.1 |
| 6 μm toner | 0.6 | 0.90 | 1.05 | 1.10 | 1.2 |
| 8 μm toner | 0.7 | 1.0 | 1.10 | 1.15 | 1.3 |
| 10 μm toner | 0.7 | 1.0 | 1.15 | 1.25 | 1.4 |

TABLE 23

Toner height and amount of development (mg/cm$^2$)

| | Toner height | | | | |
|---|---|---|---|---|---|
| Average toner particle size | About one layers | About two layers | About three layers | About four layers | About five layers |
| 4 μm toner | 0.30 | 0.45 | 0.55 | 0.60 | 0.70 |
| 6 μm toner | 0.40 | 0.55 | 0.60 | 0.65 | 0.75 |
| 8 μm toner | 0.45 | 0.60 | 0.70 | 0.75 | 0.95 |
| 10 μm toner | 0.55 | 0.70 | 0.85 | 0.95 | 1.15 |

As shown in the tables 22 and 23, the term of "about one layer" is the same as that explained with reference to the tables 12 and 13, and explanation thereof is omitted.

It is understood from the results that there is a difference in the granularities depending on the average toner particle sizes and the heights of toner, and that the difference is almost the same as a difference in the dot spreads. Referring to these figures related to FIG. 15, the granularity is degraded when the dot spread is wide or narrow. The wide dot spread means that toner dust increases upon transfer, which makes the dot spread wider than that of an image that should be developed.

Therefore, degradation in granularity is easily understood from the fact as explained above, and thus, 1.2, preferably, 1.1 or less is desired as the adequate dot spread. On the other hand, the narrow dot spread means that toner is not satisfactorily transferred. This leads to the uneven toner image and the reduced image density, and therefore, 0.7, preferably, 0.8 or more is desired as the adequate dot spread.

A smaller average toner particle size is better. This is because the small toner particle size allows a toner layer due to development to be uniform, which leads to excellent development of a latent image. This fact is easily understood from the sample images as shown in FIG. 16A to FIG. 16C. For example, one layer of toner causes the uneven toner image and reduced image density to easily occur, while increase in transfer performance causes an image with surface stain to occur.

Therefore, a ratio between the dot area on the transfer element and the dot area on the photosensitive element is preferably 0.8 to 1.1. Furthermore, the height of the toner on the transfer element and that of the toner on the photosensitive element are preferably twice to four times the average toner particle size, respectively.

Related to the amount of development, an increased amount of development causes the granularity to deteriorate. For example, if the amount exceeds 1.0 mg/cm$^2$, the granularity of the toner having a particle size of 4 micrometers is about 0.18, but the granularity of the toner having a particle size of 6 micrometers or more becomes 0.25 or higher. If the amount of development is reduced, the granularity becomes better, but if it is reduced to about 0.4 mg/cm$^2$ or less, the granularity becomes worse. Moreover, the uneven toner image, reduced image density, or nonuniform density occurs. As a result, the most preferable range of the amount of development is from about 0.4 mg/cm$^2$ to about 0.9 mg/cm$^2$.

The developing gap is set to 0.35 millimeter, but in order to faithfully develop a latent image, a developing electric field due to charges on the photosensitive element needs to be larger, which allows development to be performed more satisfactorily. However, there is another important factor which is a supply of toner. If the gap is too narrow, toner becomes short in development of a solid image, which results in an insufficient solid image. Thus, the most adequate developing gap ranges from 0.3 to 0.5 millimeter.

Smaller toner particle size allows development to be more adequate. However, if it is too small, characteristics of individual toner particles are made different from one another because of their dispersing states that depend on toner materials, and a charged amount may be lack of stability. If the toner particle size is 3 micrometers or less, environmental problems come up, and therefore, the most adequate particle size ranges from 4 to 7 micrometers.

EXAMPLE 3-4

Toner characteristic that largely contributes to development is circularity.

Pulverized toner particles having different circularities were subjected to thermal treatment and round treatment by using the Hybridization system (manufactured by Nara Machinery Co. Ltd.). The treatments were performed at a temperature of 50° C. to 60° C. and at 2,000 rpm to 8,000 rpm. An average circularity can be measured by the Flow particle image analyzer FPIA-2100 manufactured by Sysmex Corp. The measurement was conducted in the following manner. Primary sodium chloride was used to prepare 1% NaCl aqueous solution, and it was made to pass through a filter of 0.45 micrometer to obtain a liquid of 50 to 100 milliliters. The liquid was added with a surface active agent as a dispersant, preferably, 0.1 to 5 milliliters of alkyl benzene sulfonate, and further added with 1 to 10 milligrams of sample. The resultant liquid was subjected to dispersion for one minute by an ultrasonic disperser to obtain a dispersant with a particle density controlled to 5,000 to 15,000/μl, and the dispersant was used for the measurement.

A diameter of a circle having area the same as area of a two-dimensional image that was obtained by capturing a toner particle by a CCD camera was determined as a circle-corresponding diameter. A particle size of 0.6 micrometer or more based on the circle-corresponding diameter was determined as an effective value from the pixel accuracy of the CCD and used to calculate an average circularity. The average circularity is obtained by calculating circularities of particles to add the circularities of the particles to one another, and dividing the result of addition by the total number of particles. The circularity of each particle can be calculated by dividing a perimeter of a circle having projected area the same as a toner particle image by a perimeter of a projected toner particle image.

The toner formula 1 (average particle size: 7 μm) was used for toner in this example to obtain five types of circularities. The circularities obtained after being treated and estimated average granularities on the photosensitive element as results of testing are given in the following table 24.

TABLE 24

Toner circularity and average granularity

| Hybridization system: rpm (at 50 to 60° C.) | Circularity | Granularity |
|---|---|---|
| 8000 rpm | 0.99 | 0.12 |
| 6000 | 0.97 | 0.19 |
| 4000 | 0.95 | 0.24 |
| 2000 | 0.92 | 0.28 |
| Not treated | 0.88 | 0.33 |

It is understood from the results that an average circularity of 0.95 or higher allows excellent development to be performed. Since the upper limit of the circularity is 1.0 as a perfect spherical shape, 0.95 or higher is defined for excellent development.

If the average circularity is less than 0.95, the aggregation state of the toner image on the photosensitive element becomes nonuniform. Therefore, the development lacks fidelity to the latent image and uniformity of the toner image in the z-axial direction, which causes the average granularity to be degraded. Toner particles in the height direction (z-axial direction) are uneven, which causes bad influence such as transfer void to be exerted over the transfer characteristics.

EXAMPLE 3-5

Referring to the development, there is another factor to exert influence over the average granularity which is dispersion (weight average particle size: Xw/average particle size of particles: Xn) of toner particle size. The dispersion is an adequate feature for evaluating whether particle sizes of individual toner particles are nonuniform. The dispersion of 1 indicates that toner particles have an uniform particle size.

In the case of conventional pulverized type, the dispersion is generally about 1.7.

In order to obtain toner particles having different dispersions, various numbers of revolutions and various amounts of air were changed in the classifying process to prepare four types of the toner particles. A relation between the dispersion and the average granularity was then checked.

The toner formula 1 and the toner formula 8 that have different average particle sizes were used for toner in this example. The toner formula 1 has characteristics as follows: particle size: 7.0 μm, dispersion: 1.30, aggregation: 45%, volume resistivity: $8.5\times10^9$ Ω·cm, and average circularity: 0.95. The toner formula 8 has characteristics as follows: particle size: 4.0 μm, dispersion: 1.30, aggregation: 35%, volume resistivity: $1.8\times10^9$ Ω·cm, and average circularity: 0.97. The results are given in the following table 25.

TABLE 25

Toner dispersion and average granularity

| Particle size | Dispersion | average granularity |
|---|---|---|
| 4.0 μm | 1.1 | 0.14 |
| | 1.3 | 0.18 |
| | 1.5 | 0.21 |
| | 1.8 | 0.26 |
| 7.0 μm | 1.1 | 0.17 |
| | 1.3 | 0.21 |
| | 1.5 | 0.26 |
| | 1.9 | 0.30 |

From the results, the dispersion is preferably 1.3 or less. If the dispersion exceeds 1.3, the granularity deteriorates. Since the toner particle sizes are caused to be nonuniform, the charged amount fluctuates, and the developing and transfer processes are thereby badly affected. In the transfer process, the layer thickness and the surface of the toner layer are not uniform, and the toner particles are thereby in nonuniform contact with the transfer paper or the photosensitive element, which causes the transfer efficiency to lower. Therefore, a large transfer current is required, which causes discharge and leak upon separation of the transfer paper from the photosensitive element to increase.

EXAMPLE 3-6

The toner formulas 1 to 8 were used in the same method as that of the example 3-1 to prepare a developer. Spherical ferrites having a weight average particle size of 50 micrometers were used for carrier, the surface of the spherical ferrite was coated with silicone resin and thermally dried to obtain the carrier. A developer density was obtained by mixing 5.0 wt % of the toner with respect to the carrier. The pushing force for transfer was set to 3 N/cm$^2$ and the transfer current was set to 1.0 μA/cm to output the test chart as shown in FIG. 7. The transfer paper used was Type 6000 (manufactured by Ricoh Co., Ltd.), and evaluation on transfer efficiency and transfer dust were checked. The results of evaluation are given in the following table 26.

TABLE 26

Toner formula and quality of transfer

| Type of toner | Rank of transfer ratio | Rank of transfer dust |
|---|---|---|
| Toner formula 1 | ○ | ○ |
| Toner formula 2 | Δ | X |

TABLE 26-continued

Toner formula and quality of transfer

| Type of toner | Rank of transfer ratio | Rank of transfer dust |
|---|---|---|
| Toner formula 3 | Δ | Δ |
| Toner formula 4 | X | X |
| Toner formula 5 | X | X |
| Toner formula 6 | Δ | ○ |
| Toner formula 7 | X | Δ |
| Toner formula 8 | ○ | ○ |

It is understood from the tables 16 and 26 that the aggregation of toner affects the transfer efficiency. Low volume resistivity of toner affects the transfer ratio, but does not largely affect the transfer dust. Moreover, if the toner hardness is higher, it is more advantageous against the transfer dust, but the pushing force needs to be changed to improve the transfer dust because of the toner aggregation. As for the toner formula 3, for example, by changing the transfer current from 1.0 μA/cm to 0.8 μA/cm, the rank "Δ" of the transfer dust was improved to Based on the table 16 and the table 26, it is apparent that the adequate aggregation of toner is from 20% to 50% and the appropriate volume resistivity of toner is $1\times10^9$ Ω·cm or higher.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus comprising:

an image carrier that is rotatable and that carries a toner image;

a developing unit that forms the toner image with toner in powder form on the image carrier in such a manner that thickness of a layer of toner of the toner image is between two to five times of an average particle size of the toner; and a transferring unit that transfers the toner image to a transfer unit in such a manner that a ratio between a width of dot areas of the toner image on the image carrier and a width of dot areas on the transfer unit, is from 0.8 to 1.1.

2. The image forming apparatus according to claim 1, wherein the transferring unit includes a roller that is rotatable and has a surface layer that is made of elastic material having a hardness of equal to or less than 60 degrees, wherein a ratio between a speed of the image carrier and a speed of the transfer roller is from 0.95 to 1.05, and the roller pressed against the image carrier at a pressure of from 1.0 N/cm$^2$ to 3.0 N/cm$^2$ to maintain the ratio between 0.8 and 1.1.

3. The image forming apparatus according to claim 1, wherein the developing unit has a developing sleeve and the developing unit is arranged with a developing gap, which is a space between the image carrier and the developing sleeve, of from 0.3 millimeter to 0.5 millimeter, and the toner of the toner image has a dispersion of particle sizes of equal to or less than 1.3 and an average circularity of equal to or higher than 0.95.

4. The image forming apparatus according to claim 1, wherein the developing unit has a developing sleeve and the developing unit is arranged with a developing gap, which is a space between the image carrier and the developing sleeve, of from 0.3 millimeter to 0.5 millimeter, an amount of toner in the toner image on the image carrier is from 0.4 mg/cm$^2$ to 0.9 mg/cm$^2$, and the toner of the toner image has a dispersion of particle sizes of equal to or less than 1.3, an average particle size of from 4.0 micrometers to 7.0 micrometers, and an average circularity of equal to or higher than 0.95.

5. The image forming apparatus according to claim 1, further comprising a transfer bias current applying unit that applies to the transferring unit a transfer bias current that is not more than a leak current from the transfer unit that passes between the image carrier and the transferring unit, and that is not less than a current at which electrostatic transfer is possible.

6. The image forming apparatus according to claim 1, wherein the toner has an aggregation of from 20 percent to 50 percent and a volume resistivity of equal to or more than $1\times10^9$ ohm-centimeters.

7. An image forming method comprising:

forming on an image carrier, which is rotatable, a toner image with toner in powder form on the image carrier in such a manner that thickness of a layer of toner of the toner image is between two to five times of an average particle size of the toner; and a transferring unit transferring the toner image to a transfer unit in such a manner that a ratio between a width of dot areas of the toner image on the image carrier and a width of dot areas on the transfer unit, is from 0.8 to 1.1.

8. The image forming method according to claim 7, wherein at the step of transferring, a ratio between a speed of the image carrier and a speed of a transfer roller is from 0.95 to 1.05, which is a substantially equal speed, and the toner image is transferred to a transfer element so that the ratio between the dot areas is from 0.8 to 1.1, wherein a transfer pressure is from 1.0 N/cm$^2$ to 3.0 N/cm$^2$.

9. The image forming method according to claim 7, wherein at a step of developing, a developing gap that is a space between the image carrier and a developing sleeve is from 0.3 millimeter to 0.5 millimeter, and a toner image is formed on the image carrier with toner having a dispersion of particle sizes of equal to or less than 1.3 and an average circularity of equal to or higher than 0.95.

10. The image forming method according to claim 7, wherein at a step of developing, a developing gap that is a space between the image carrier and a developing sleeve is from 0.3 millimeter to 0.5 millimeter, and an amount of toner development on the image carrier after the toner image is developed is from 0.4 mg/cm$^2$ to 0.9 mg/cm$^2$, the toner has a dispersion of particle sizes of equal to or less than 1.3, an average particle size of from 4.0 micrometers to 7.0 micrometers, and an average circularity of equal to or higher than 0.95.

11. The image forming method according to claim 7, further comprising applying to the transferring unit a transfer bias current that is not more than a leak current from the transfer unit that passes between the image carrier and the transferring unit, and that is not less than a current at which electrostatic transfer is possible.

12. The image forming method according to claim 7, wherein the forming includes forming the toner image on the image carrier with toner having an aggregation of from 20 percent to 50 percent and a volume resistivity of equal to or more than $1\times10^9$ ohm-centimeters.

* * * * *